US011215395B2

(12) United States Patent
Cavagne et al.

(10) Patent No.: US 11,215,395 B2
(45) Date of Patent: Jan. 4, 2022

(54) ELEMENT FOR CONSTRUCTION OF A MASS- AND/OR HEAT-EXCHANGE DEVICE, ASSEMBLY OF TWO ELEMENTS AND EXCHANGE METHOD USING AN ASSEMBLY

(71) Applicant: L'Air Liquide, Societe Anonyme pour l'Etude et l'Exploitation des Procedes Georges Claude, Paris (FR)

(72) Inventors: Patrice Cavagne, Le Perreux (FR); Benoit Davidian, Saint Maur des Fosses (FR); Bernard Saulnier, La Garenne Colombes (FR)

(73) Assignee: L'Air Liquide Société Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 377 days.

(21) Appl. No.: 16/307,330

(22) PCT Filed: Jun. 2, 2017

(86) PCT No.: PCT/FR2017/051383
§ 371 (c)(1),
(2) Date: Dec. 5, 2018

(87) PCT Pub. No.: WO2017/212144
PCT Pub. Date: Dec. 14, 2017

(65) Prior Publication Data

US 2019/0137174 A1 May 9, 2019

(30) Foreign Application Priority Data

Jun. 6, 2016 (FR) ..... 1655111
Jun. 6, 2016 (FR) ..... 1655112
Jun. 6, 2016 (FR) ..... 1655113

(51) Int. Cl.
*F25J 3/02* (2006.01)
*F25J 3/04* (2006.01)

(52) U.S. Cl.
CPC ..... *F25J 3/0489* (2013.01); *F25J 3/0295* (2013.01); *F25J 3/04945* (2013.01);
(Continued)

(58) Field of Classification Search
CPC ..... F25J 3/0489; F25J 3/04969; F25J 3/0295; F25J 3/04945; F25J 2290/42; F25J 2290/30
See application file for complete search history.

(56) References Cited

U.S. PATENT DOCUMENTS 3,281,334 A 3/1965 Williamson
4,872,955 A 10/1989 Parker et al.
(Continued)

FOREIGN PATENT DOCUMENTS

EP 0 728 999 8/1996
EP 0 913 653 5/1999
(Continued)

OTHER PUBLICATIONS

International Search Report and Written Opinion for PCT/FR2017/051383, dated Sep. 26, 2017.
Anonymous: "Insulation System," Mason Publications, Hampshire, GB, vol. 451, No. 60, Nov. 1, 2001.

*Primary Examiner* — Brian M King
(74) *Attorney, Agent, or Firm* — Justin K. Murray

(57) ABSTRACT

A stackable modular element comprises a parallelepipedal caisson, the caisson comprising at least one layer of thermal insulation of thickness less than one-third of the width of the caisson, the layer of insulation covering at least the lateral and frontal faces of the caisson and surrounding at least one chamber having a parallelepipedal volume within the caisson, the chamber containing at least one body of material
(Continued)

Section X-X that permits the exchange of mass and/or of heat, the body being parallelepipedal in shape and filling at least part of the chamber, the chamber having an opening on the upper face and/or an opening on the lower face to allow fluid to be transferred to the body from outside the element and/or from the body to outside the element.

16 Claims, 22 Drawing Sheets

(52) U.S. Cl.
CPC ..... *F25J 3/04969* (2013.01); *F25J 2290/30* (2013.01); *F25J 2290/42* (2013.01)

(56) References Cited

U.S. PATENT DOCUMENTS

| | | | | |
|---|---|---|---|---|
| 2004/0050095 | A1 | 3/2004 | Brigham et al. | |
| 2009/0211295 | A1* | 8/2009 | Cavagne | F25J 3/0295 62/617 |
| 2011/0031861 | A1* | 2/2011 | Gentry | F25J 1/0261 312/406 |
| 2013/0111950 | A1 | 5/2013 | Cavagne | |
| 2015/0096327 | A1 | 4/2015 | Lochner et al. | |
| 2016/0245585 | A1* | 8/2016 | Howard | F25J 3/04175 |

FOREIGN PATENT DOCUMENTS

| | | |
|---|---|---|
| EP | 2 657 633 | 10/2013 |
| FR | 3 017 939 | 8/2015 |

* cited by examiner

Section X-X

Section Y-Y

Device - Dismantling / Relocation

ELEMENT FOR CONSTRUCTION OF A MASS- AND/OR HEAT-EXCHANGE DEVICE, ASSEMBLY OF TWO ELEMENTS AND EXCHANGE METHOD USING AN ASSEMBLY

CROSS-REFERENCE TO RELATED APPLICATIONS

This application is a § 371 of International PCT Application PCT/FR2017/051383, filed Jun. 2, 2017, which claims § 119(a) foreign priority to French patent application 1655111, filed Jun. 6, 2016, French patent application 1655112, filed Jun. 6, 2016, and French patent application 1655113, filed Jun. 6, 2016.

BACKGROUND

Field of the Invention

The present invention relates to a modular element for construction of a mass- and/or heat-exchange device, an assembly of at least two such modular elements and a method of exchange of mass and/or of heat with such an assembly.

The invention also relates to a device constituted at least partially by such an assembly of at least two such modular elements.

The present invention relates in particular to a cryogenic distillation device, such as an air separation device, constituted at least partially by an assembly of modular elements according to the invention and to a method for modification of such a device.

Related Art

On the other hand, the invention applies equally to other mass- and/or heat-exchange devices, such as a heat exchanger, an adsorption purification device or a distillation column.

SUMMARY OF THE INVENTION

The device according to the invention can be installed and commissioned rapidly. Once installed, its capacity and/or its energy efficiency can be easily increased or reduced. Its maintenance is less complicated and if necessary it is easy to relocate it. Moreover, it is easy to modify the device according to the invention by modifying its capacity and/or the content of the products that it has to produce. A product can equally be added or removed.

At present an air separation device may be composed of a plurality of packets, each containing an entire equipment unit of the device, for example a complete column, a complete heat exchanger, a complete adsorption type air head purification unit. The dimensions of each packet are determined by the equipment unit that it must contain and the packets therefore all have different dimensions. Most of the packets are placed directly on the ground.

It has been proposed to dispose equipment units of the air separation device in packets, for example containers, each containing a complete equipment unit.

The assembly of heterogeneous packets each containing an equipment unit necessitates a major human effort for assembly (welding, wiring, etc.), but also for commissioning (verification, test).

It is known from U.S. Pat. Nos. 4,872,955 and 3,281,334 to manufacture a distillation column in a plurality of parts to be stacked.

In the case of distillation that is not carried out at ambient temperature, for example cryogenic distillation, once the column has been assembled, it is necessary to construct an enclosure around the column and to fill it with insulating material.

It is also known from EP-A-913653 to place a first distillation column operating at one pressure in the insulating enclosure and to dispose another distillation column operating at another pressure in another insulating enclosure above the first column. This type of construction necessitates the use of a crane and the assembly of the two enclosures is complicated.

EP2657633 describes a modular element in which two heat-exchange bodies are disposed in an insulated enclosure. The two bodies have small openings in their upper surface to allow the passage of a conduit.

An object of the invention is to facilitate the configuration of a device for treatment of a gas, for example a residual gas from an industrial process or an air separation device employing cryogenic distillation or part of such a device. The device can therefore be constructed more rapidly and with relatively unskilled labor. In addition, a modular element containing a defective element can be replaced easily without it being necessary to replace the entire equipment unit.

According to one object of the invention, there is provided a stackable modular element for construction of a mass- and/or heat-exchange device comprising a parallelepipedal box having a length, a width and a height, the box having opposite horizontal upper and lower faces, two opposite vertical end faces and two opposite vertical lateral faces, the upper and lower faces of the box being defined by the length and the width of the box, the two end faces of the box by the length and the height of the box and the two lateral faces of the box by the width and the height of the box, the box containing at least one layer of thermal insulation with a thickness less than one third of the width of the box, the insulating layer covering at least the lateral and end faces of the box and possibly the upper and lower faces and surrounding at least one chamber with a parallelepipedal volume inside the box, the at least one chamber having a length, a width and a height, the chamber having opposite horizontal upper and lower faces, the upper face and/or the lower face of the chamber being at least partially open, two opposite vertical end faces and two opposite vertical lateral faces, the upper and lower faces of the chamber being defined by the length and the width of the chamber, the two end faces of the chamber by the length and the height of the chamber and the two lateral faces of the chamber by the width and the height of the chamber, the chamber containing at least one body of material enabling the exchange of mass and/or of heat, the body being of parallelepipedal shape and filling at least a part of the chamber, the chamber having an opening on the upper face and/or an opening on the lower face communicating with an opening in the upper face of the box and/or an opening in the lower face of the box respectively to enable the transfer of fluid to the body from the outside of the element and/or from the body to the outside of the element.

According to other, optional aspects:

the at least one body fills at least a part of the chamber inside the box and i) another body enabling the exchange of mass and/or of heat fills another part, or even the rest, of the chamber or another chamber and/or ii) at least one material transfer conduit passes through the other part, or even the rest of the chamber or another chamber, to enable the material to pass through the box or iii) the other part, or even the rest of the chamber or the other chamber constitutes a means enabling the transfer of material through the box.

According to other, optional aspects:

- the height of the element is less than the length of the element, or even less than or equal to the width of the element.
- the height of the body is equal to at least half the height of the element, if not equal to the height of the element.
- at least one body is a body of adsorbent material.
- at least one body is constituted by a stack of vertically oriented metal plates, the plates being separated by fins.
- at least one body is constituted by a stack of vertically oriented corrugated plates, the corrugations being oriented at an angle between 10° and 80° to the horizontal.
- a range of element sizes having been predefined, the dimensions of the modular element are chosen to correspond to an element size that is part of the range.
- the chamber is open on the upper face and the lower face of the box and the height of the chamber is substantially equal to the height of the box.
- the chamber is open on the upper face or the lower face of the box and closed on the opposite face of the latter.
- at least one of the vertical faces of the box takes the form of a plane surface.
- at least the upper face and/or the lower face of the box comprises connecting means for making a connection between adjacent elements.
- the at least one chamber has a horizontal section of substantially square, rectangular or circular shape.
- the chamber has a uniform horizontal section over all the height of the chamber.
- the chamber is closer to a lateral wall of the box than the opposite lateral wall of the box.
- the box is made of metal, preferably of aluminum or of stainless steel or of carbon steel or of Invar.
- the walls of the at least one chamber are made of metal, preferably of aluminum or of stainless steel or of Invar.
- the element is self-supporting.
- the element has a length between 3 and 30 meters.
- the element has a height between 1 and 5 meters.
- the element has a width between 1 and 5 meters.
- the thickness of the insulation layer is less than 500 mm, or less than 300 mm, or less than 150 mm, or even 100 mm.
- the volume of the chamber or of the chambers constitutes at least 30% of the volume of the element.
- the element comprises four vertical beams connecting the upper face of the box to the lower face of the box at the corners, so that mechanical forces are transmitted via the corners of these faces.
- the box is constituted of a standardized container, preferably having standardized corners, for example in accordance with the standard ISO 668.
- an opening in the upper face of the chamber communicates with an opening in the upper face of the box, the two openings preferably having substantially the same dimensions.
- an opening in the lower face of the chamber communicates with an opening in the lower face of the box, the two openings preferably having substantially the same dimensions.
- the opening in the lower face and/or the upper face of the box occupies at least 20% of the surface of the respective face of the box.
- the opening in the lower face and/or the upper face of the chamber occupies at least 20% of the surface of the respective face of the chamber, preferably all the surface of the respective face of the chamber.

According to another aspect of the invention, there is provided an assembly of at least one first modular element and at least one second modular element stacked one on the other and in contact one with the other, the first and second elements being as described hereinabove, the elements being disposed so that at least one body of the first element is disposed above at least one body of the second element, the body of the first element and the body of the second element above which it is disposed both being constituted of i) adsorbent material or ii) a stack of vertically oriented metal plates, the plates being separated by fins or iii) a stack of vertically oriented corrugated plates, the corrugations being oriented at an angle between 10° and 80° to the horizontal and the modular element of the first element has the same length and width as that of the second element.

The box of the first element preferably has the same length and width as that of the second element.

The chamber of the first element preferably has the same length and width as that of the second element.

The central points of the chambers of the first element and the second element are preferably on a common vertical axis.

The body of the first element preferably has the same length and width as that of the second element.

According to other, optional aspects of the invention:

- the at least one material transfer conduit passes through the other part, or even the rest of the chamber or another chamber, to enable the material to pass through the box of the first element and/or
- the other part, or even the rest of the chamber or the other chamber constitutes a means enabling the transfer of material through the box of the first element.
- the at least one material transfer conduit passes through the other part, or even the rest of the chamber or another chamber, to enable the material to pass through the box of the second element and/or the other part, or even the rest of the chamber or the other chamber constitutes a means enabling the transfer of material through the box of the second element.

- the material transfer conduit of the first element is connected to the material transfer means of the second element, this means possibly being the material transfer conduit of the second element, or even a part of the chamber or another chamber of the second element.
- the other part, or even the rest of the chamber or the other chamber of the first element is connected to the material transfer means of the second element, this means possibly being the material transfer conduit of the second element, or even a part of the chamber or another chamber of the second element.
- the material transfer conduit of the first element is the transfer conduit of the second element.
- a material transfer conduit passes through the first and second elements, or even most of, or even all of the elements of the assembly.

the assembly comprises at least one means for causing at least one fluid or electricity to circulate from one element to another and passing through at least one conduit, which may be a cable, or a chamber of each element.

the elements are fixed one to the other by connecting the lower edges of the four lateral and end walls of the box of the first element to the upper edges of the four lateral and end walls of the box of the second element, by welding and/or adhesion using a seal and/or an adhesive and/or a mechanical attachment, possibly with the use of a seal, preferably only at the corners, the assembly produced in this way possibly providing a seal.

the assembly comprises a third element in contact with the first or the second element, the third element being parallelepipedal and having a length and a width and a height, the third element having opposite horizontal upper and lower faces, two opposite vertical end faces and two opposite vertical lateral faces, the upper and lower faces of the third element being defined by the length and the width of the modular element, the two end faces of the modular element by the length and the height of the third element and the two lateral faces of the modular element by the width and the height of the third element, the third element not containing any element enabling the exchange of material as described in claim 3 but containing at least one cable and/or at least one conduit for transferring electricity or a fluid from the first or from the second element.

According to another aspect of the invention, there is provided a gas treatment device, for example an air separation device employing cryogenic distillation in which:

i) a unit for purification of the gas, for example air, is at least partially constituted by an assembly of at least two elements as described hereinabove, the adsorbent is capable of adsorbing water and/or carbon dioxide and/or some of the secondary impurities in the air, the assembly comprising means for sending gas thereto, for example air, to be purified of water and/or carbon dioxide connected to an element of the assembly and means for taking up purified gas from another element of the assembly and/or ii) a heat exchanger is at least partially constituted by an assembly of at least two elements as described above, the assembly comprising means for sending a gas, for example air or an atmosphere gas, to an element of the assembly and means for taking up the gas at a higher or lower temperature from another element of the assembly and/or iii) a distillation column is at least partially constituted by an assembly of at least two elements as described hereinabove, the assembly comprising means for sending to it a gas, for example air or an atmosphere gas, connected to an element of the assembly and means for taking up a gas that has been purified or enriched with a component of the gas from another element of the assembly.

According to another aspect of the invention, there is provided a method of exchange of mass and/or of heat in an assembly or a device as described hereinabove in which at least one first fluid is introduced into the body of an element of an assembly and a second fluid derived from the first fluid is removed from the body of another element of the assembly.

The exchange of mass and/or of heat is preferably carried out at a pressure of less than 2 bar, preferably at a pressure at most equal to 400 mbar above atmospheric pressure.

According to the present invention, at least some functional parts of the device for treatment of a gas, for example an air separation device, are constituted at least partially, preferably entirely, by modular elements.

The entire device may be composed of modular elements.

According to another object of the invention, there is provided an assembly of at least one first, one second and one third stackable modular elements for construction of a mass- and/or heat-exchange device, each of the first and second elements comprising a parallelepipedal box having a length, a width and a height, the box having opposite horizontal upper and lower faces, two opposite vertical end faces and two opposite vertical lateral faces, the upper and lower faces of the box being defined by the length and the width of the box, the two end faces of the box by the length and the height of the box and the two lateral faces of the box by the width and the height of the box, the box containing at least one layer of thermal insulation having a thickness less than one third of the width of the box, the layer of insulation covering at least one of the lateral and end faces of the box and the upper and lower faces possibly surrounding at least one chamber having a parallelepipedal volume inside the box, the at least one chamber having a length, a width and a height, the chamber having opposite horizontal upper and lower faces, the upper face and/or the lower face of the chamber being at least partially open, two opposite vertical end faces and two opposite vertical lateral faces, the upper and lower faces of the chamber being defined by the length and the width of the chamber, the two end faces of the chamber by the length and the height of the chamber and the two lateral faces of the chamber by the width and the height of the chamber, the chamber containing at least one body of material enabling the exchange of mass and/or of heat, the body being of parallelepipedal shape and filling at least a part of the chamber, the first and second elements each having the chamber featuring an opening on the upper face communicating with an opening in the upper face of the box and an opening on the lower face communicating with an opening in the lower face of the box respectively to enable the transfer of fluid to the body from the exterior of the element and/or from the body to the exterior of the element and the third element comprising a parallelepipedal box having a length, a width and a height, the box having opposite horizontal upper and lower faces, two opposite vertical end faces and two opposite vertical lateral faces, the upper and lower faces of the box being defined by the length and the width of the box, the two end faces of the box by the length and the height of the box and the two lateral faces of the box by the width and the height of the box, the first and second elements are disposed above the third element or below the third element, in contact therewith, the third element comprising at least one first opening to enable the transfer of fluid from/to the chamber of at least one first element and at least one second opening to enable the transfer of fluid to/from the chamber of at least one second element, i) at least one (the) first and at least one (the) second opening being found in the upper face or at least one (the) first and at least one (the) second opening being found in the lower face of the third element, or ii) at least one (the) first opening being found in the upper face and at least one (the) second opening being found in the lower face of third element.

According to other, optional aspects:

the at least one body fills at least a part of the chamber inside the box of the first and/or second element and i) another body enabling the exchange of mass and/or of heat fills another part, or even the rest, of the chamber or another chamber, and/or ii) at least one material transfer conduit passes through the other part, or even the rest of the chamber or another chamber, to enable the material to pass through the box, or iii) the other part, or even the rest of the chamber or another chamber constitute a means enabling the transfer of material through the box.

where applicable i) at least one body is a body of adsorbent material, and/or ii) at least one body is constituted by a stack of vertically oriented metal plates, the plates being separated by fins, and/or iii) at least one body is constituted by a stack of vertically oriented corrugated plates, the corrugations being oriented at an angle between 10° and 80° to the horizontal.

the first element contains a body as described in the variant i) or ii) or iii) of claim 3 and the second element contains a body as described in the variant i) or ii) or iii) of claim 3.

the third element does not contain any body as described in variant i), ii) or iii) of claim 3.

the first element has the same length and/or width and/or height as the second element.

the first, second and third elements are disposed with their lengths disposed in the same direction.

the sum of the lengths of the first and second elements is less than, equal to or greater than the length of the third element.

the first and second elements are disposed with their lengths disposed in the same direction and the third element is disposed with its length perpendicular to the lengths of the first and second elements.

the sum of the widths of the first and second elements is substantially equal to the length of the third element.

n third elements are disposed below or above the first and second elements, each third element being in contact with the first and second elements and each of the first and second elements comprising n openings to enable the transfer of fluid from/to each of the third elements.

the length of the first and/or the second element is substantially equal to the sum of the widths of the three elements, each third element preferably having the same width, and the length of the first and/or the second element being substantially equal to n times the width of a third element.

the third element has a height greater than or less than the height of the first and/or second element.

the third element is below the first and second elements.

the third element is fixed to the ground.

the box of the third element contains at least one layer of thermal insulation with a thickness less than one third of the width of the box, the insulating layer covering at least the lateral and end faces of the box and possibly the upper and lower faces surrounding at least one chamber having a parallelepipedal volume inside the box, the third element contains at least one chamber having a length, a width and a height, the chamber having opposite horizontal upper and lower faces, the upper face and/or the lower face of the chamber being at least partially open, two opposite vertical end faces and two opposite vertical lateral faces, the upper and lower faces of the chamber being defined by the length and the width of the chamber, the two end faces of the chamber by the length and the height of the chamber and the two lateral faces of the chamber by the width and the height of the chamber, a chamber of the third element contains at least one body of material enabling the exchange of mass and/or of heat, the body being of parallelepipedal shape and filling at least a part of the chamber, the first and second elements each having the chamber featuring an opening on the upper face communicating with an opening in the upper face of the box and an opening on the lower face communicating with an opening in the lower face of the box respectively to enable the transfer of fluid to the body from the exterior of the element and/or from the body to the exterior of the element.

the third element contains means for transferring at least one fluid from the first element to the second element and/or from the second element to the first element.

the third element contains at least one conduit and/or at least one duct, one end of which is connected to at least one body and/or at least one transfer conduit of the first element and the other end is connected to the at least one body and/or at least one transfer conduit of the second element.

the at least one conduit and/or the at least one duct is covered with insulation.

the at least one conduit and/or the at least one duct is covered with insulation and disposed in the insulation that fills the space inside the third element.

at least the end and lateral faces of the third element are covered with a layer of insulation.

the third element contains command and/or control and/or analysis and/or instrumentation and/or utility supply means.

the box of the third element contains on at least one face at least one layer of thermal insulation having a thickness possibly at least less than a third of the width of the box.

the first and/or second element constitutes the lower or upper element of a stack of elements, each element of the stack comprising a parallelepipedal box having a length, a width and a height, the box having opposite horizontal upper and lower faces, two opposite vertical end faces and two opposite vertical lateral faces, the upper and lower faces of the box being defined by the length and the width of the box, the two end faces of the box by the length and the height of the box and the two lateral faces of the box by the width and the height of the box.

at least one element of the stack is a support element not comprising openings to enable the entry or the exit of a fluid.

for at least one element of the stack, the box contains at least one layer of thermal insulation having a thickness less than one third of the width of the box, the layer of insulation covering at least the lateral and end faces of the box and possibly the upper and lower faces and surrounding at least one chamber having a parallelepipedal volume inside the box, the at least one chamber having a length, a width and a height, the chamber having opposite horizontal upper and lower faces, the upper face and/or the lower face of the chamber being at least partially open, two opposite vertical end faces and two opposite vertical lateral faces, the upper and lower faces of the chamber being defined by the length and the width of the chamber, the two end faces of the chamber by the length and the height of the chamber and the two lateral faces of the chamber by the width and the height of the chamber, the chamber containing at least one body of material enabling the exchange of mass and/or of heat, the body being of parallelepipedal shape and filling at least a part of the chamber.

each element of the stack or most elements of the stack contain(s) a body composed of only one of the variants i) to iii) of claim 3, the elements being disposed so that at least one fluid can circulate in the stack of elements via the body.

the third element comprises openings in only one face that is the upper face or the lower face.

the third element comprises at least two openings in one of the faces that is the upper face or the lower face and at least one opening in the opposite face.

the first and/or second element constitutes the lower or upper element of a stack of elements, connected by the first and/or second element to a first third element and also connected to a second third element disposed at an intermediate point of the stack or at the other end of the stack.

According to another aspect of the invention, there is provided a plurality of juxtaposed assemblies, each assembly being according to any one of the preceding claims in which the third element of one of the assemblies is connected to the third element of another assembly through a fourth element comprising a parallelepipedal box, placed in contact with the third elements in order to enable the transfer of fluid from one assembly to the other through the fourth element and the third element.

According to another aspect of the invention, there is provided a device for treatment of a gas, for example a device for separation of air by cryogenic distillation, in which:

i) a unit for purification of the gas, for example air, is at least partially constituted by an assembly according to claim 3 variant i), the adsorbent is capable of adsorbing water and/or carbon dioxide and/or some of the secondary impurities in the air, the assembly comprising means for sending to it gas, for example air, to be purified of water and/or carbon dioxide connected to an element of the assembly and means for taking up the purified gas from another element of the assembly, and/or ii) a heat exchanger is at least partially constituted by an assembly according to claim 3 variant ii), the assembly comprising means for sending a gas, for example air or an atmosphere gas, to an element of the assembly and means for taking up gas at a higher or lower temperature from another element of the assembly, and/or iii) a distillation column is at least partially constituted by an assembly according to claim 3, variant iii), the assembly comprising means for sending to it a gas, for example air or an atmosphere gas, connected to an element of the assembly and means for taking up a gas purified of or enriched with a component of the gas from another element of the assembly.

According to another object of the invention, there is provided a method for exchange of mass and/or heat in an assembly or a device as described hereinabove in which at least one first fluid is introduced into the body of an element of an assembly and a second fluid derived from the first fluid is removed from the body of another element of the assembly.

the exchange of mass and/or of heat is carried out at a pressure of less than 2 bar, preferably at a pressure at most equal to 400 mbar above atmospheric pressure.

According to another object of the invention, there is provided a method for construction or modification of a device for exchange of material and/or of heat, the device for exchange of mass and/or heat comprising an assembly of at least one first stackable modular element and one second modular stackable element, each of the first and second elements comprising a parallelepipedal box having a length, a width and a height, the box having opposite horizontal upper and lower faces, two opposite vertical end faces and two opposite vertical lateral faces, the upper and lower faces of the box being defined by the length and the width of the box, the two end faces of the box by the length and the height of the box and the two lateral faces of the box by the width and the height of the box, the box containing at least one layer of thermal insulation with a thickness less than one third of the width of the box, the layer of insulation covering at least the lateral and end faces of the box and possibly the upper and lower faces and surrounding at least one chamber of parallelepipedal volume inside the box, the at least one chamber having a length, a width and a height, the chamber having opposite horizontal upper and lower faces, the upper face and/or the lower face of the chamber being at least partially open, two opposite vertical end faces and two opposite vertical lateral faces, the upper and lower faces of the chamber being defined by the length and the width of the chamber, the two end faces of the chamber by the length and the height of the chamber and the two lateral faces of the chamber by the width and the height of the chamber, the chamber containing at least one body of material enabling the exchange of mass and/or of heat, the body being of parallelepipedal shape and filling at least a part of the chamber, the first element having the at least one chamber featuring an opening on the lower face communicating with an opening in the lower face of the box and the second element having the at least one chamber featuring an opening on the upper face communicating with an opening in the upper face of the box to enable the transfer of fluid from the body of the first element to the body of the second element and/or from the second element to the body of the first element wherein a) the first element is fixed on top of the second element or the second element is fixed underneath the first in a sealed manner, so that a fluid can pass from the body of the first element to the body of the second element and/or from the body of the second element to the first element body, and/or b) the first element is unfastened from the second element, on top of which it is fixed in a sealed manner, or the second element is unfastened from the first element underneath which it is fixed in a sealed manner, so that a fluid can pass from the body of the first element to the body of the second element and/or from the second element to the body of the first element.

According to other aspects of the invention, there are provided:

the body of the first element and the body of the second element are both i) a body of adsorbent material, or ii) a stack of vertically oriented metal plates, the plates being separated by fins, or iii) a stack of vertically oriented corrugated plates, the corrugations being oriented at an angle to the horizontal between 10° and 80°.

the at least one body fills at least a part of the chamber inside the box of the first and/or the second element and i) another body enabling the exchange of mass and/or heat fills another part, or even the rest, of the chamber or another chamber, and/or ii) at least one material transfer conduit passes through the other part, or even the rest of the chamber or another chamber, to enable the material to pass through the box, and/or iii) the other part, or even the rest of the chamber or the other chamber constitutes a means enabling the transfer of material through the box.

the assembly constitutes at least a part of an adsorbent bed, a heat exchanger or a preferably cryogenic distillation device and in that i) the addition of the second element enables increasing of the capacity of the assembly and/or increasing the efficiency of the assembly, or ii) the removal of the second element enables reduction of the capacity of the assembly and/or reduction of the efficiency of the assembly and/or reduction of the volume of the assembly the first and/or second element constitute(s) an element or elements, possibly a lower or upper element, of a stack of at least two elements, each element of the stack comprising a parallelepipedal box having a length, a width and a height, the box having opposite horizontal upper and lower faces, two opposite vertical end faces and two opposite vertical lateral faces, the upper and lower faces of the box being defined by the length and the width of the box, the two end faces of the box by the length and the height of the box and the two lateral faces of the box by the width and the height of the box, most of the elements, or even each element, of the stack having the same width and possibly the same length and/or the same height.

at least one element of the stack may be longer than other elements of the stack, preferably longer than most of, or even all of the elements of the stack.

the first element is added into the stack of elements above the second element and below another element.

the first element is removed and the first element is replaced by another element having the same body type, i) ii) or iii) as described in claim 3 as the first body, but having a greater capacity and/or better efficiency and/or less defective operation than that of the first element.

the first element is removed and it is replaced by an element of parallelepipedal shape having the same length and the same width as the first element but not containing a body of same type as the first body, or even not containing a body of type i) to iii) described in claim 3.

a first stack is assembled principally comprising body elements of type i) or of type ii) or of type iii) as described in claim 3 and a second stack is assembled principally comprising body elements of type i) or type ii) or type iii) as described in claim 3 so that a lateral face of the second stack is substantially in contact with a lateral face of the first stack.

a third stack is assembled principally comprising body elements of type i) or of type ii) or of type iii) as described in claim 3 so that a lateral face of the second stack is substantially in contact with a lateral face of the third stack.

the first stack principally contains body elements of type i) and/or the second stack principally contains body elements of type ii) and/or the third stack principally contains body elements of type iii).

an element of the first stack or the second stack contains an air compressor intended to feed with air elements of the stack of bodies of type i) or ii).

In a variant of the method i) according to the above variant a), the first and/or second element is taken up in a manufacturing center or a logistical platform, and/or ii) according to the above variant b), the first and/or second element is deposited in a/the manufacturing center or a/the logistical platform, the manufacturing center or the logistical platform preferably containing a plurality of elements identical to the first element and/or a plurality of elements identical to the second element.

According to one variant, a first and/or second element is unfastened from a first device in accordance with the above step b), the unfastened element is deposited in a manufacturing center or a logistical platform, the unfastened element is possibly reconditioned there, the unfastened element is taken up in the center or the platform to transport it to a second device where it is fixed in accordance with the above step a) to another element to form part of the second device.

The invention proposes to use modular elements that make it possible to assemble and to start up a device for treatment of a gas, for example an air separation device, rapidly, the modular elements being manufactured in the factory and being of easily transportable size, typically the size of a standardized maritime container.

The modular elements are easily fastened together to facilitate the construction of a device and are also easily unfastened, to facilitate modification or relocation of the elements.

Fluid or electrical or instrumentation type connections between adjacent modular elements, but also the seal between adjacent modular elements, will be effected at the level of the interfaces between two adjacent elements, by one modular element being back-to-back with another, requiring little or not human intervention.

It can obviously be envisaged that fluid or electrical or instrumentation connections can be effected by means disposed on exterior walls of adjacent or non-adjacent modular elements.

The operation of the modular elements will have been completely validated ahead of the transportation of the element (verification, quality control, etc.).

Moreover, the modular aspect enables increasing or reducing the size of the device for processing a gas, for example an air separation device, and also easy dismantling for installation on another site, adding or removing modular elements from the modular elements in the same device. The modular aspect also enables easy multiplication of the number of devices in parallel ("multi-train" concept).

For maintenance, service exchange with another modular element could be envisaged.

Some modular elements could possibly be changed during the life of the device, for example for a modular element offering better energy performance (although undoubtedly more costly) if the cost of energy increases. This configuration method can also be applied to adjustment of production of liquid, gas under pressure, etc.

The use of gas fluid connectors in particular will be facilitated by the use of the concept of a device operating at atmospheric pressure or a pressure slightly above atmospheric pressure, for which a certain leakage rate might possibly be tolerated.

According to the invention, a single modular element size may be chosen having given dimensions for installing therein a part of the equipment of the device, using a plurality of modular elements of the same size. Otherwise, two modular element sizes may be chosen, the modular elements of the two sizes each having the same height and the same width but the length of one modular element being twice that of the other modular element. In this case a number of modular elements of a first size and a number of modular elements of a second size will be used.

The dimensions are chosen so that at least one equipment unit of the device is not only transported to site in the modular element but also installed in situ to form part of the device that functions inside the same modular element as that used for its transportation.

In some cases, an entire equipment unit of a device, or even a plurality of entire equipment units, may fit in a modular element; for example the equipment unit may be a boiler or a condenser, a heat exchanger, for example a smaller heat exchanger, such as a subcooler, a pump, a compressor, a turbine, an expansion valve or a control, instrumentation or electrical plant room.

In other cases, in particular when the equipment unit when ready to use is of great height, it is necessary to design the equipment unit as a series of parts, each of which is disposed in an individual modular element. The modular elements are then stacked and the parts connected in series inside the modular elements to enable operation of the parts in series, with at least one fluid from one modular element passing into the other modular element. Thus the stacked parts constitute the entire equipment unit, such as a column enabling exchange of heat and/or of material, for example a distillation column or a scrubber column or a heat exchanger or an adsorption or absorption tower.

The height of the part is chosen so that the part can fit into the modular element. To improve its stability, the modular element is disposed with its length parallel to the ground, its width also parallel to the ground and its height being perpendicular thereto.

In the situation where only one modular element size is used, the length of the modular element is preferably at least 1.5 times the height of the modular element, or even at least twice the height of the modular element, or even at least four times the height of the modular element.

In the situation where only one modular element size is used, the length of the modular element is preferably at least 1.5 times the width of the modular element, or even at least twice the width of the modular element, or even at least four times the width of the modular element.

In the situation in which only one modular element size is used, the width of the modular element may be greater than or less than or equal to the height of the modular element.

In the situation where only one modular element size is used, the length of the modular element is obviously greater than the height of the modular element and greater than its width.

In the situation where two modular element sizes are used, the length of the shorter modular element is preferably at least 1.25 times the height of the shorter modular element, or even at least 1.5 times the height of the shorter modular element, or even at least twice the height of the shorter modular element. The length of the longer modular element is preferably at least 2.5 times the height of the longer modular element, or even at least 3 times the height of the longer modular element, or even at least 4 times the height of the longer modular element.

In the situation where two modular element sizes are used, the length of the shorter modular element is preferably at least 1.25 times the width of the shorter modular element, or even at least 1.5 times the width of the shorter modular element, or even at least twice the width of the shorter modular element. The length of the longer modular element is preferably at least 2.5 times the width of the longer modular element, or even at least 3 times the width of the longer modular element, or even at least 4 times the width of the longer modular element.

In the situation where two modular element sizes are used, the shorter modular element and the longer modular element have the same height and the same width.

In the situation where two modular element sizes are used, the height of the longer modular element is half of the height of the shorter modular element and/or the length of the longer modular element is substantially twice the length of the shorter modular element.

The modular elements may have various configurations.

The modular elements can each contain a part of an equipment unit having only one principal function.

For example, an equipment unit, such as a heat exchanger, can be constituted in part or entirely of stacked modular elements.

An adsorption purification device can be constituted in part or entirely of stacked modular elements.

A distillation or scrubber column can be constituted in part or entirely of stacked modular elements.

A modular element need not contain instrumentation or an electrical power supply and in this case does not necessarily require validation/testing in the factory, other than quality control.

To the contrary, a modular element can contain objects having a multitude of functions (rotating machines, such as a compressor, a turbine or a pump, electrical, instrumentation, process components, fluid distribution devices (pipes, valves, etc.), thus becoming a complex module that necessitates complete validation/testing/inspection in the factory.

The modular element can contain equipments having an "ancillary" function such as support, control room, electrical plant room, instrumentation/analysis room, stores/spare parts, etc.

The modular elements can be arranged so that their length is disposed vertically and/or horizontally relative to the ground, once installed to constitute the device. The position with the length disposed horizontally relative to the ground when the element is installed at its final position is preferred for reasons of stability and ease of assembling the elements. Moreover, as these elements are generally transported with their length in the horizontal direction, for example by truck or boat, the element remains in the same position for transportation and final installation. It is therefore not necessary to provide support inside the element to prevent its contents from moving when the element is in a vertical position, since the element is always in the horizontal position, whether this be for transportation, installation on site or final disposition on site.

The structure of at least the modular elements in contact with sections of the device operating at a below ambient temperature, or even cryogenic temperature, will be made of a material that is mechanically resistant to low temperatures or of a more conventional material protected by adequate thermal insulation.

The walls of the modular element will be plane, or "domed" outward or inward if it is wished to contain the pressure more easily. The inward "bombed" solution facilitates transport (the wall does not project beyond the "supporting" structure).

The insulation could be integrated into the walls and into the structures exposed to the ambient medium, for example with the aid of vacuum panels. The use of more conventional insulation (particulate, for example perlite, rock or glass wool packing) could also be provided as a function of the accessibility required for maintenance of the equipment units concerned.

The wall of the internal zone with its insulation if any delimits a chamber and can directly "contain" the body having a process function (for example, exchange waves for heat exchange, structured packing for distillation, adsorbent for adsorption, compression, expansion). The connectors enabling transfer of at least one fluid between the modular elements may be brazed or preferably a mechanical system with possibly a seal compatible with the cryogenic temperatures and with the nature of the product to facilitate evolution and easy dismantling, as much at the level of fluid distribution ("pipes") as at the level of a connection between two parts of the same process function. The mechanical strength of the assembly of modular elements can, for example, be provided by a twist-lock type system preferably housed in the standardized corners of the modular element), independently of the "fluid" connections, the "fluid" connections, merely providing a seal, possibly being imperfect.

The other connectors (electricity, instrumentation) are of more conventional "plug and play" type.

There may also be pipes external to the modular elements to connect two parts of the device, notably in the case of fluids pressurized above a given threshold.

The modular elements have guides and quick locking systems at the corners, enabling accurate "plug and play" connections.

The civil engineering can remain simple, using a single flat slab or only piles situated under the structure, possibly only under the corners, of each modular element resting on the ground. The modular element resting on the ground may possibly be reinforced, for example by adding contact points in contact with the ground.

The modular elements preferably have a structure such that mechanical forces between elements or the ground are absorbed in the corners.

The insulation of a modular element is integrated into the walls of the element and possibly the structure of the element. This avoids the formation of thermal bridges.

A modular element has at least one, or even two or three, greater dimensions and at least one, or even two or three, smaller dimensions and/or at least one dimension, or even two or three, equal to those of a standardized maritime container. The modular element typically has at least one dimension corresponding to the size of a standardized 20 feet or 40 feet maritime transport container, i.e. approximately 2.5×2.5×6 m or 2.5×2.5×12 m.

An element can have at its eight corners a standardized maritime container corner, for example one in accordance with the standard ISO 668.

The invention will be described in more detail with reference to FIGS. 1, 3 and 4 that represent modular elements according to the invention, and FIG. 2 that represents two modular elements stacked to form an assembly according to the invention, FIGS. 5 to 8, that represent assemblies of modular elements according to the invention, FIG. 9, that represents a section of assembled modular elements according to the invention, FIG. 10, that represents a section of modular elements in accordance with the invention, FIGS. 11 to 13, that represent assemblies of modular elements according to the invention, and FIGS. 14 to 19 that represent a life cycle of an assembly of modular elements according to the invention.

DETAILED DESCRIPTION OF THE INVENTION

Figure 1A:
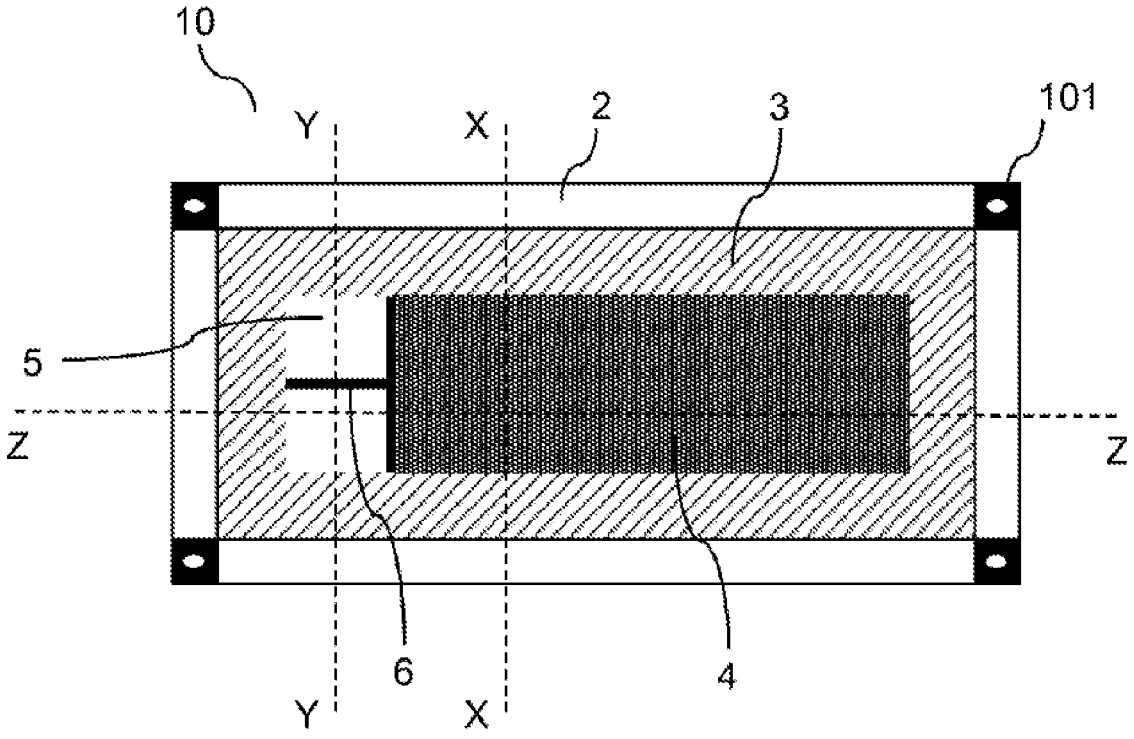
FIG. 1*a* is a schematic view from above of a modular element in accordance with one embodiment of the present invention.

FIG. 1*a* is a view from above of a modular element. A view from below would be substantially identical.

The modular element 10 is an element enabling an exchange of material and/or of heat. It is composed of a box 2 of parallelepipedal shape, formed for example of metal beams. The element includes eight "container" type ISO 101 corners fixed to the box 2 and has a width oriented horizontally relative to the ground, a length oriented horizontally relative to the ground and a height oriented vertically relative to the ground, when it is installed to form part of a device.

ISO containers are subject to specific construction standards and performance tests. The same applies to ISO corners.

ISO corners are certified by an internationally recognized organization to enable their "multimodal" use in maritime, road, rail or even air transport.

Steel, aluminum or stainless steel ISO corners are commercially available according to their specified use.

The element comprises a box having opposite horizontal upper and lower faces, two opposite vertical end faces and two opposite vertical lateral faces, the upper and lower faces of the box being defined by the length and the width of the box, the two end faces of the box by the length and the height of the modular element and the two lateral faces of the box by the width and the height of the box. The lateral and end walls are for example made of sheet metal. The faces formed by the width and the length of the element are open to enable the passage of fluids. Alternatively, the opening may be smaller than the surface of the lower and/or upper face, covering at least part of the insulation 3 and possibly a part of the zone 4.

It is obvious that the height and the width of the element are not necessarily identical, and so the lateral walls may all be rectangular without being square. The walls may also be smaller than the box of the element. The walls are preferably fixed to the inside of the box 2, but may be fixed to its outside. Insulation 3 lines the inside of the box 2, at least on the vertical sides of the parallelepiped. The upper and/or lower surface may also comprise a wall and be insulated. The insulation 3 can be pressed onto a plate which bears on the box 2 to make a "fluid" seal between the interior and the surroundings. The insulation 3 can also provide this sealing function directly, together with the structural wall function. By default, a fluid-tight wall, for example a metal plate, may be applied on the interior side to the insulation 3. The box 2 and the insulation 3 delimit an internal zone. The box 2, the wall and/or the insulation 3 can be sized to contain any overpressure inside the internal zone.

The internal zone surrounds a zone 4. This zone 4 contains a body that enables transfer of mass and/or heat, for example a structured packing for distillation, an exchanger matrix with plates and fins for exchange of heat, adsorbent in ball or structured form for adsorption. This zone can also contain a support zone, for example in the lower part, fluid distribution zones, for example in the lower and/or upper part. It can also be divided into a plurality of parts, for example vertically, with walls that may be fluid-tight and/or structural walls (for example to resist a pressure difference) and/or thermally insulative walls. The body preferably fills all the section of the zone 4.

At least one fluid circulates up or down through the zone 4. In some cases, for example that of distillation, a fluid, for example a gas, circulates upward and another, for example a liquid, downward through the zone 4.

The internal zone may consist entirely of the zone 4. However, as shown, it can equally well contain at least one other zone, for example here a fluid circulation zone 5, delimited by a fluid-tight and possibly insulating wall 6, in some kind of duct. The part in contact with the insulation 3 can be delimited by a fluid-tight, for example metal, wall, if the insulation does not provide this function. In the situation in the figure, two fluid circulation zones 5 are delimited by a vertical fluid tight wall 6. This enables replacement of gas or liquid conduits of a conventional device by causing circulation of at least one fluid that has to be sent to a higher or lower modular element and not treated by exchange of mass and/or of heat in the element through which it or they circulate(s).

II is equally feasible for the internal zone to comprise a plurality of zones 4. For example, there could be a first zone 4 and a second zone separated from one another, each containing structured packing for out distillation or an exchanger matrix with plates and fins for exchange of heat or adsorbent in ball or structured form for adsorption.

Similarly, the at least two zones could each have a different function or different dimensions, one containing structured packing and the other an exchanger matrix with plates and fins.

The fluid directed to the zone 5 can be directly in contact with the walls of the zone, which separate the zone from the insulation. Otherwise the fluid can be contained in a conduit that passes through the zone.

Figure 1B:
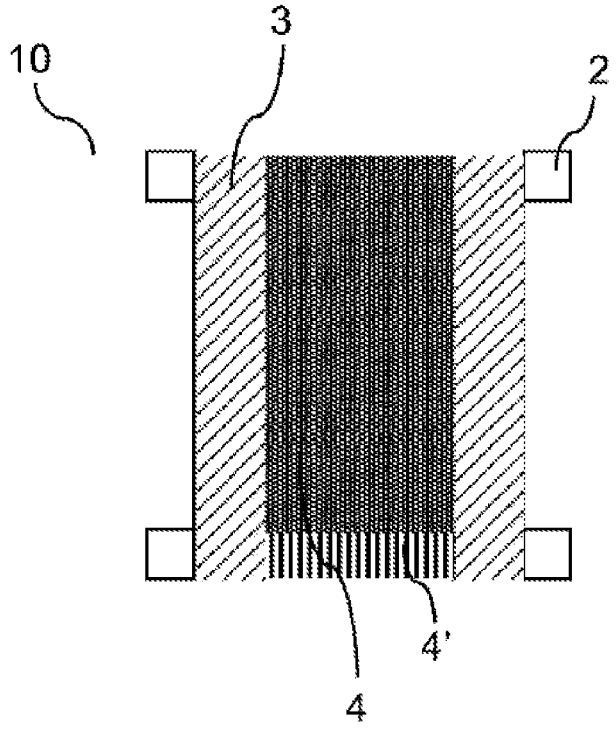
FIG. 1*b* represents a section taken along the line X-X in FIG. 1*a* in accordance with one embodiment of the present invention.

FIG. 1*b* represents a section taken along the line X-X in FIG. 1*a*. There are seen there the four beams of the box 2 and two of the lateral walls attached to the interior of the beams and covered with insulation 3. A mass and/or heat-exchange body of the first zone 4 is held in place by the insulation 3 and is supported by a distributor 4' intended to distribute a gas passing from the exterior of the element to the body or from the body to the exterior of the element. This distributor can also serve to hold the body in place. This distributor can be reduced to a set of support beams. The body can be a body for exchange of mass only, a body for exchange of heat only (for example a heat exchanger with plates and fins) or a body for exchange of mass and heat.

Figure 1C:
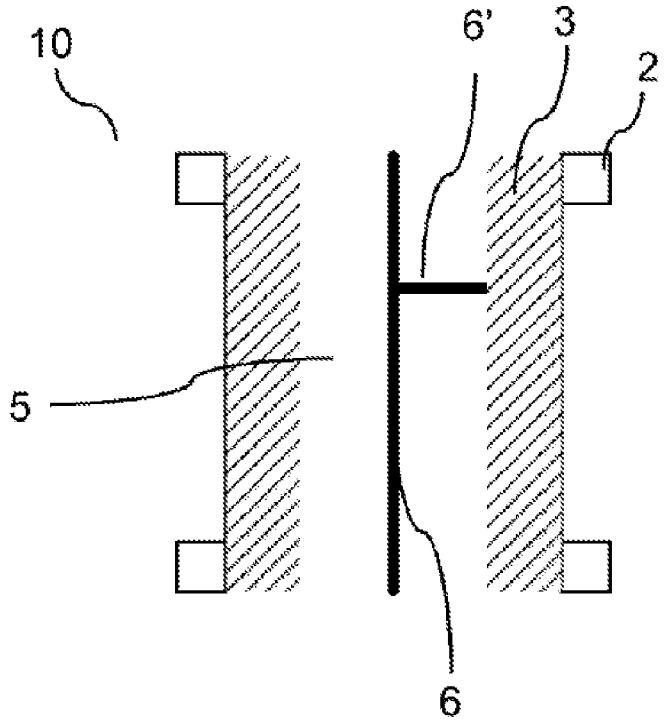
FIG. 1*c* shows a variant of the element in section taken along the line Y-Y in FIG. 1*a* in accordance with one embodiment of the present invention.

FIG. 1*c* shows a variant of the element in section taken along the line Y-Y in FIG. 1*a*. There is seen there the four box beams 2 and two of the lateral walls attached to the interior of the beams and covered with insulation 3.

A barrier 6 divides the chamber 5 in two to form two gas paths, one of the two paths being again divided in two by the barrier 6', the barriers 6, 6' forming a T. The gas arriving from outside the element rises or descends in the path.

Figure 1D:
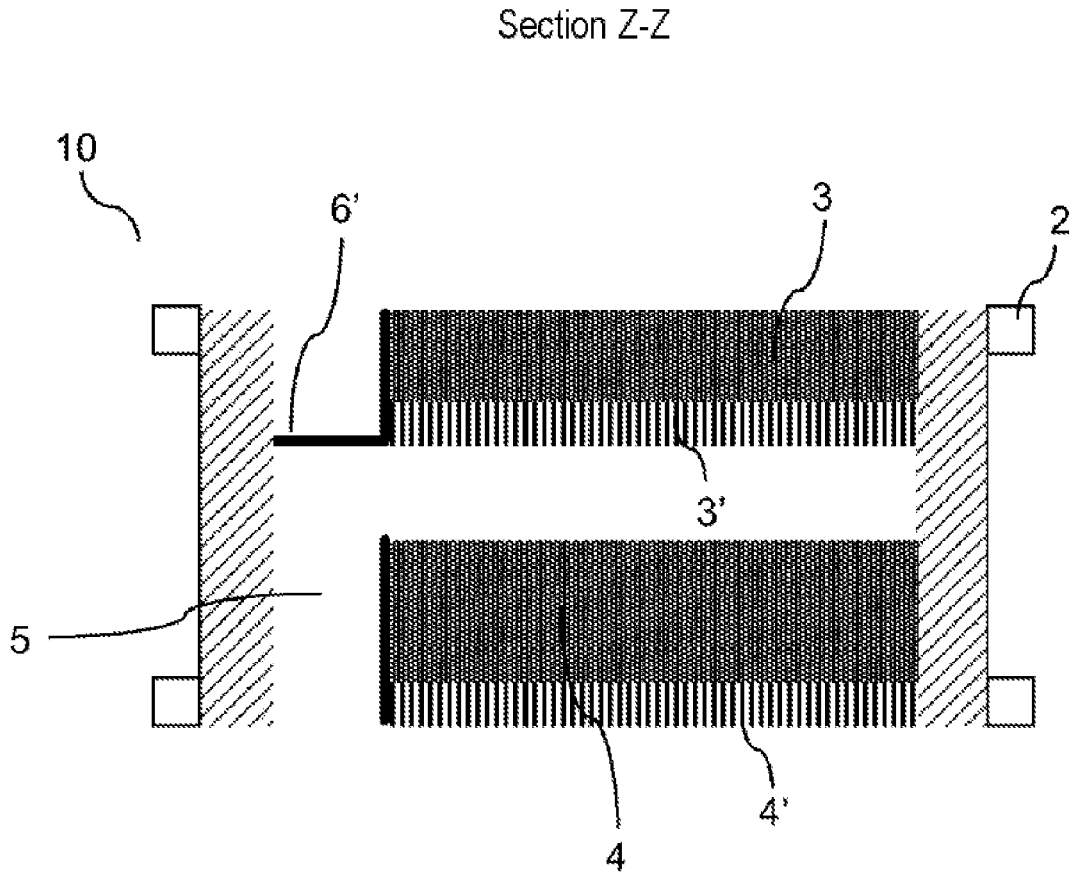
FIG. 1*d* shows a variant of the element from FIG. 1*c* in section taken along the line Z-Z in FIG. 1*a* in accordance with one embodiment of the present invention.

FIG. 1*d* shows a variant of the element from FIG. 1*c* in section taken along the line Z-Z in FIG. 1*a*. Here instead of occupying all the height of the element as in the most frequent case of FIGS. 1*a*, 1*b*, 1*c*, the body is divided into two parts 3, 4, each having a distributor and/or a set of support beams, toward the bottom, the two parts being separated vertically from one another by a space. The gas rising in the path 5 beside the body 4 enters into the body 3 on passing through the distributor 3'.

Figure 2:
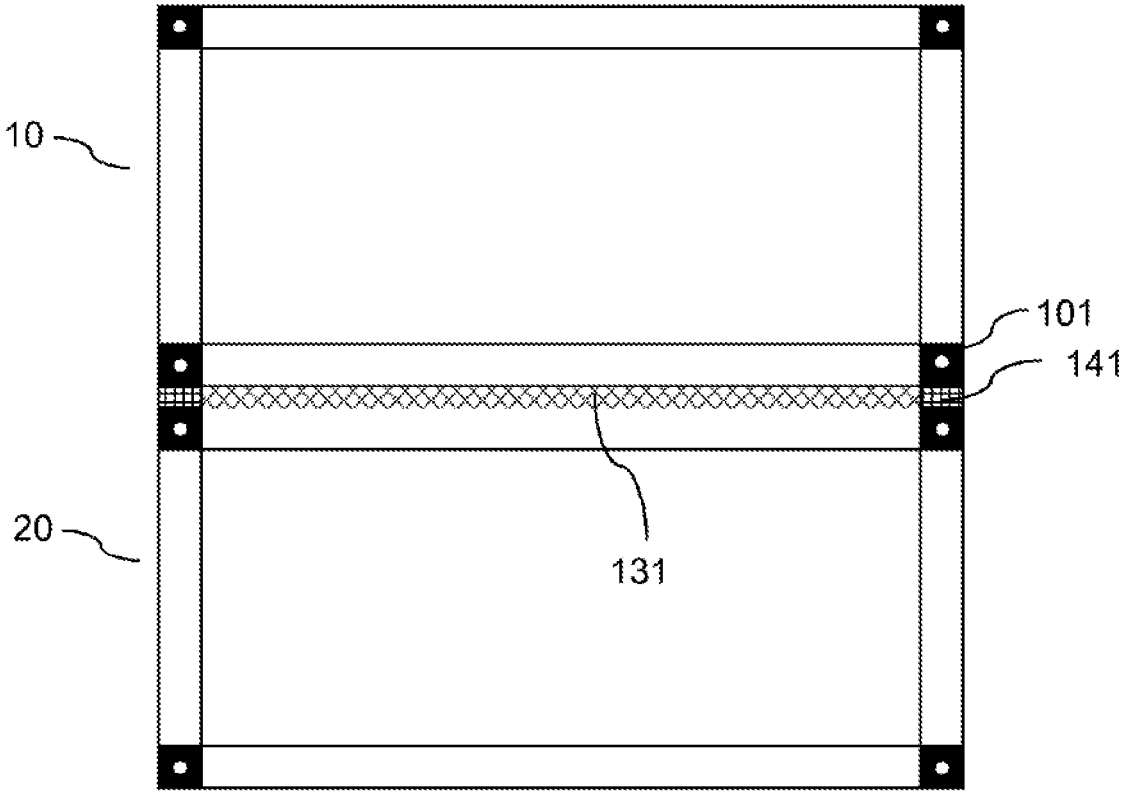
FIG. 2 represents a schematic side view of an assembly of two modular elements according to FIG. 1*a* in accordance with one embodiment of the present invention.

FIG. 2 represents a side view of an assembly of two modular elements according to FIG. 1*a*. For each modular element there are seen there the four beams of the box and one of the lateral walls covered with insulation.

The stack of two modular elements 10 and 20 of parallelepipedal shape forms an assembly of two modular elements interconnected by mechanical connecting parts 141 at the level of the ISO corners 101. The opening between the two modular elements of parallelepipedal shape, generated by the connecting part 141 and/or by the separation of the beams between the frameworks of the two modular elements, is filled in by an element 131 that provides both the seal with respect to the exterior and the continuity of the insulation between the two modular elements 10 and 20 of parallelepipedal shape. The element 131 can consist of a plurality of sub-elements, for example one providing the insulation function and another the sealing function. The connecting part 141 can be made so that the upper and lower ISO corners are in contact, for example, via a mechanical connection inside the ISO corners or outside it and using the lateral holes of the ISO corners. The opening between the two modular elements of parallelepipedal shape is then reduced to its minimum, of approximately 2 cm, corresponding to the positioning separation of the horizontal metal beams and the ISO corner 101, generally around 1 cm.

Other ways of assembling the modular elements and/or of providing the seal between the modular elements may be envisaged, for example welding and/or a seal, for example made of PTFE or its derivatives and/or adhesive bonding as well as or instead of a mechanical connection. The beams can be interconnected via a mechanical system, typically using nuts and bolts, like a pipe flange, to reinforce the seal if necessary.

Obviously more than two elements can be assembled in this manner.

As the two elements have the same length and the same width, it suffices to fix one element to the other by the contiguous corners 101 in order to attach the elements together. The space between the elements is filled at least with the seal 131 so that the fluids in the zones 4 cannot escape from the assembly of elements but pass entirely from one element to the other.

Figure 3:
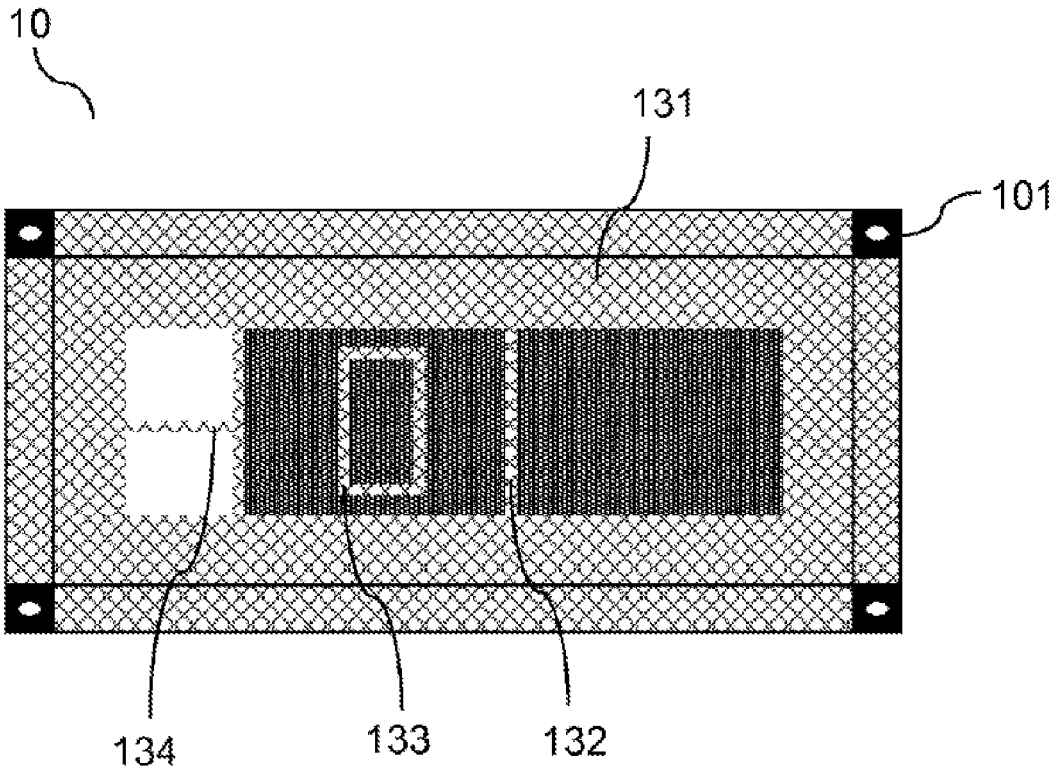
FIG. 3 represents a schematic top view of a modular element according to FIG. 1*a* carrying the sealing element 131 in accordance with one embodiment of the present invention.

FIG. 3 represents a top view of a modular element according to FIG. 1*a* carrying the sealing element 131.

This figure shows the location of the sealing element, for example a seal 131, at the interface between two modular elements 10, 20 of parallelepipedal shape. The element 131 bears on the insulation, and preferably also on the box 2, except for the ISO corners 101. Other elements 132, 133 and 134, possibly of the same kind as the element 131, are going to provide fluid continuity between the two modular elements 10, 20 of parallelepipedal shape, in terms of sealing and possibly insulation: the element 132 when the zone 4 has been divided into a plurality of parts, for example vertically, with walls that can be fluid-tight, the element 133 when it is wished to channel a fluid leaving the zone 4, typically following heat transfer, the element 134 for the fluid circulation zones 5.

These elements 131, 132, 133 and 134 can be installed when assembling the two modular elements 10, 20 of parallelepipedal shape. These elements 131, 132, 133 and 134 can possibly constitute one and the same piece.

Figure 4:
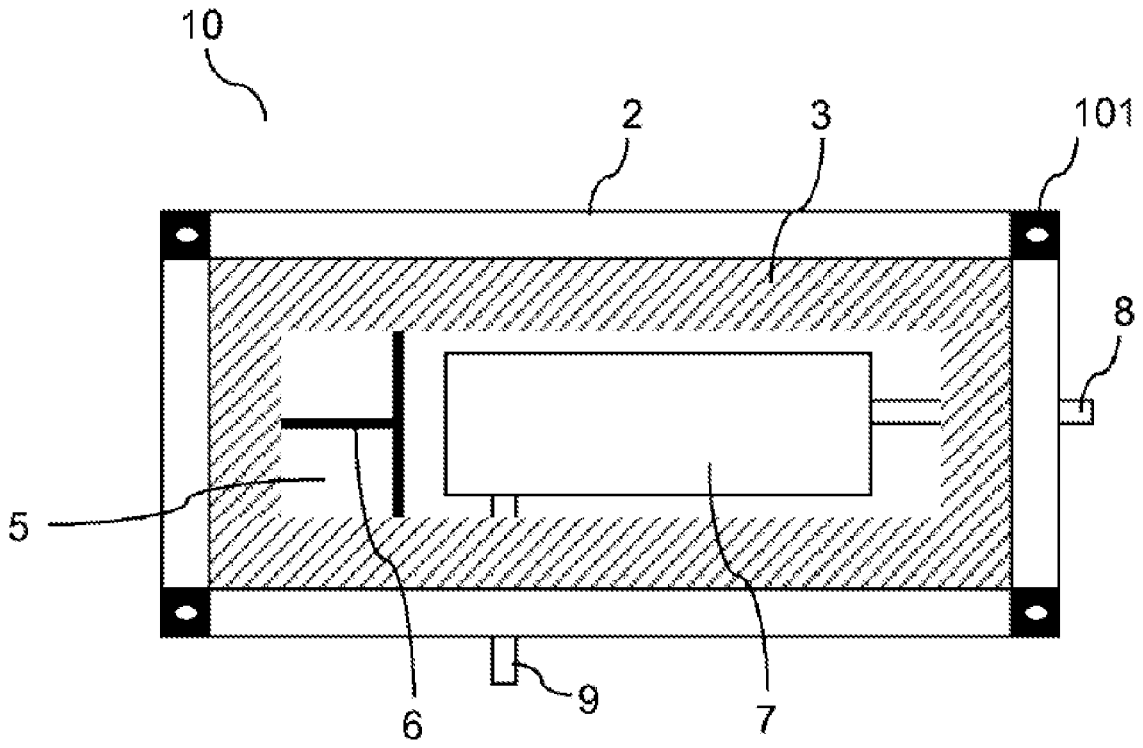
FIG. 4 is a schematic top view of a variant of FIG. 1*a* in accordance with one embodiment of the present invention.

FIG. 4 is a top view of a variant of FIG. 1*a* in which the zone 4 does not contain a body which is only a part of a mass/heat transfer element but contains a complete equipment unit 7, for example a heat transfer unit, which includes for example an inlet 8 and an outlet 9, which pass through the insulation 3, the possibly structural and/or sealing wall, and possibly the structure 2.

In this case, an element of a separation device is sufficiently small or too complex to be divided into a plurality of sections, each of which would be found in a respective modular element. This is typically the case of heat exchangers used as boilers or as condensers.

At least one fluid circulates up or down through the interface between two modular elements of parallelepipedal shape, at the level of the zone 4, the two modular elements of parallelepipedal shape being of the FIG. 4 type, or of the FIG. 1*a* type and of the FIG. 4 type.

Figure 5:
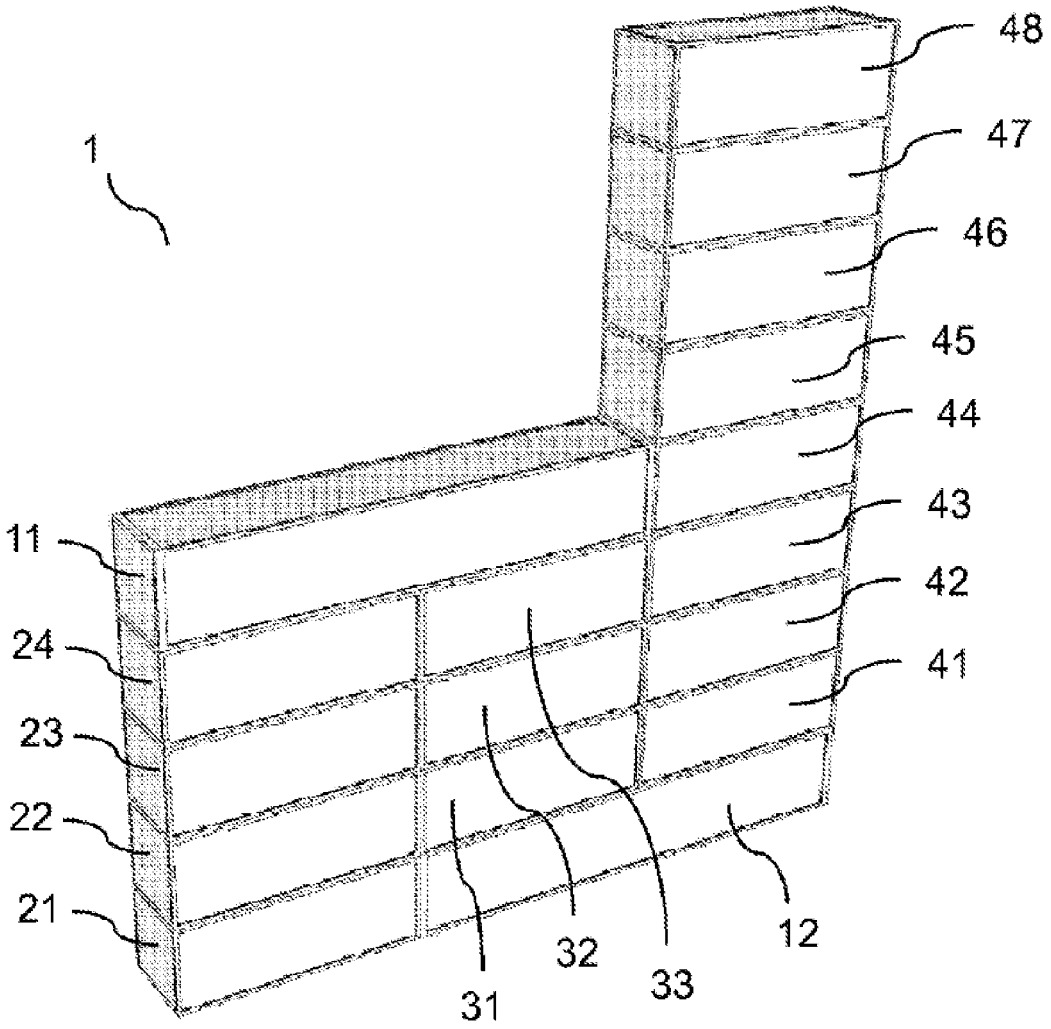
FIG. 5 is a schematic representation of a device 1 for separation of gas, at least in part constituted of various modular elements in accordance with one embodiment of the present invention.

In FIG. 5, a device 1 for separation of gas, for example air, is at least in part constituted of various modular elements 11, 12, 21, 22, 23, 24, 31, 32, 33, 41, 42, 43, 44, 45, 46, 47 and 48 as described for at least one of the preceding figures. They are of parallelepipedal shape and comprise at least eight corners 101 for example of ISO container type, fixed onto a structure, assembled for example as described hereinabove.

For example, the modular elements 11 and 12 may have the dimensions of a standardized container 40 feet long and the other modular elements 21, 22, 23, 24, 31, 32, 33, 41, 42, 43, 44, 45, 46, 47 and 48 the dimensions of a standardized container 20 feet long.

The circulation of the fluids respectively in a first stack composed of the modular elements 21, 22, 23 and 24, a second stack composed of the modular elements 31, 32 and 33, a third stack composed of the modular elements 41, 42, 43, 44, 45, 46, 47 and 48 is effected essentially vertically in each modular element and each stack, and essentially vertically at the interface 11, 12 between two modular elements of the stack. Each stack is disposed so that the longest edge of the modular elements is parallel to the ground.

In the case of separation of air, the first stack 21, 22, 23 and 24 can essentially provide the pre-cooling and head purification function, the second stack 31, 32 and 33 the heat exchange function and the third stack 41, 42, 43, 44, 45, 46, 47 and 48 the cryogenic distillation function between nitrogen and oxygen.

The third stack could constitute a single column operating at low pressure or a plurality of columns at different pressures, each constituted by a few elements from the stack.

The modular elements 11 and 12 notably enable the fluids to be caused to circulate horizontally through rectangular ducts and/or round pipes so as to transfer the fluids respectively between the first stack 21, 22, 23 and 24 and the second stack 31, 32 and 33, the second stack 31, 32 and 33 and the third stack 41, 42, 43, 44, 45, 46, 47 and 48. The modular elements 11 and 12 can also provide process and/or control and/or utilities functions. For example they can contain command and/or control and/or analysis and/or instrumentation and/or utility, such as electricity or instrument air supply means.

The modular element 11 straddles the modular elements 24 and 33, above the first and second stacks, and the modular element 12 straddling the modular elements 31 and 41 under the second and third stack. The modular elements 11 and 12 preferably include intermediate ISO corners 102 to facilitate assembly respectively with the modular elements 24 and 33, with the modular elements 31 and 41.

The modular element 11, 12 can be insulated in various ways. It can be insulated by depositing insulation on the outside of the box. It can be insulated by covering the inside of the end and lateral faces with insulation and likewise the upper or lower face if the latter is exposed. Another possibility is to insulate the at least one conduit or the at least one duct inside the element 11, 12.

As the elements 11, 12 comprise only two openings, these openings being found in the lower face and the upper face respectively, the elements 11, 12 essentially serve to transfer a fluid from one stack to the adjacent stack, and possibly to change the direction of flow of the fluids passing through the stacks. Thus a fluid passing upwards through the first stack can pass downwards through the second stack. Nevertheless it should be noted that a fluid can pass through both stacks in the same direction. For example, a gas passes through the first stack and is directed to the second stack by passing through the element 11. It then descends to the element 31 via the zone 5 of the elements 33, 32, 31 before being directed to the chamber of the element 31.

This would make it possible, for example, to constitute a distillation column, using two stacks of elements, for example the two first stacks from FIG. 5. The gas rising in the distillation body of the elements 21 to 24 would be directed via the zones 5 of the elements 33 to 31 to the distillation body of the elements 31 to 33 that it will pass through from the bottom.

The column constituted in this way would have a particularly low height.

Figure 6:
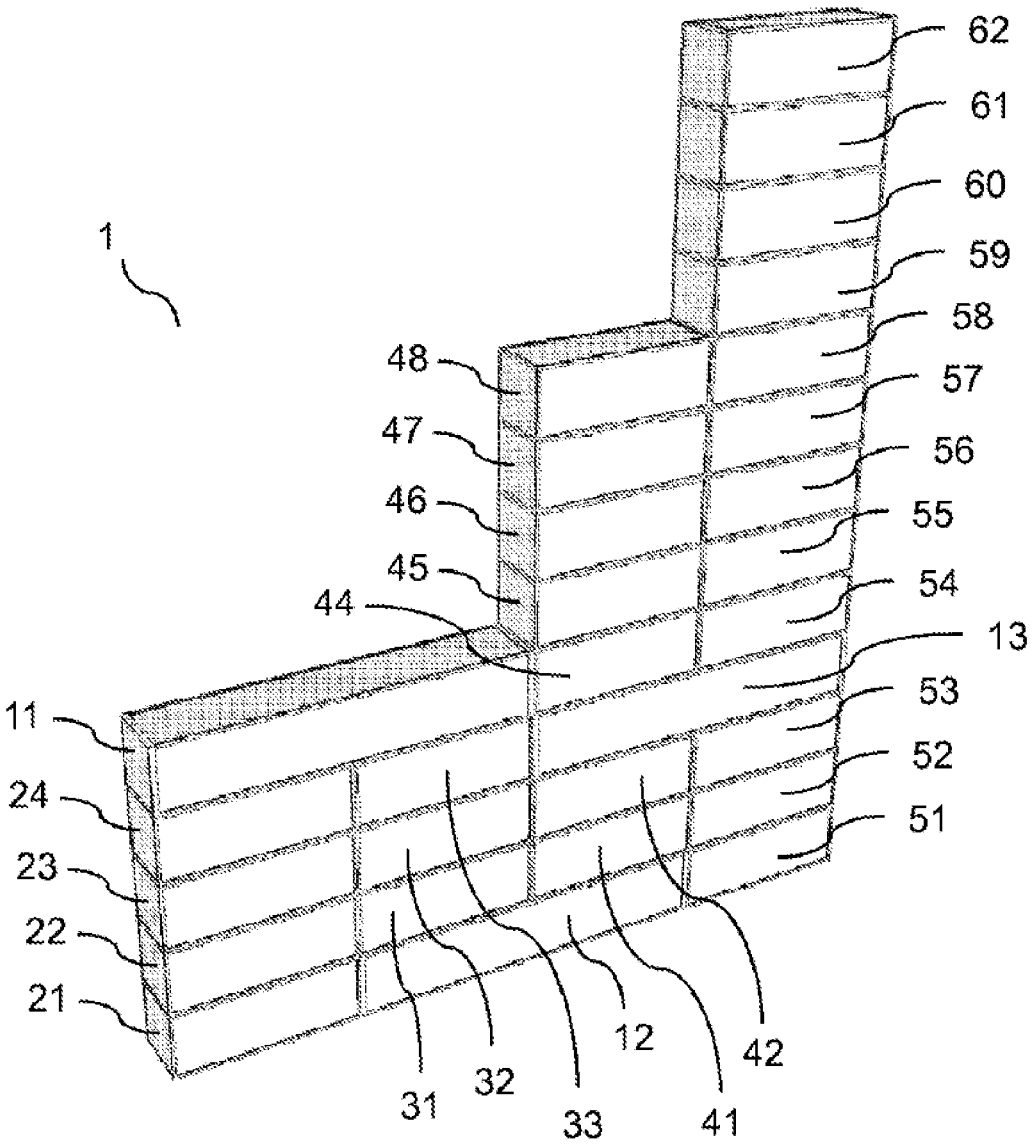
FIG. 6 is a schematic representation of FIG. 5 with the addition of a supplementary fourth stack composed of the modular elements which in the case of air separation can essentially fulfil the function of cryogenic distillation between argon and oxygen in accordance with one embodiment of the present invention.

FIG. 6 differs from FIG. 5 by the addition of a supplementary fourth stack composed of the modular elements 51, 52, 53, 54, 55, 56, 57, 58, 59, 60, 61 and 62, which in the case of air separation can essentially fulfil the function of cryogenic distillation between argon and oxygen.

The modular element 43 from FIG. 5 has been replaced by the modular element 13 that notably enables the fluids to be caused to circulate horizontally through rectangular ducts and/or round pipes so as to transfer the fluids respectively between the third stack 41, 42, 44, 45, 46, 47 and 48 and the supplementary fourth stack 51, 52, 53, 54, 55, 56, 57, 58, 59, 60, 61 and 62.

The modular element 13 is placed inside the third stack (between the modular elements 42 and 44) and inside the supplementary fourth stack (between the modular elements 53 and 54). If necessary the modular element 13 enables fluids to be caused to circulate vertically between the lower part of the third stack 41 and 42 and the higher part of the third stack 44, 45, 46, 47 and 48. In this case the modular element 13 enables division of the gases coming from only one stack between two stacks. Here for example a gas from an intermediate point of the third stack, constituting a simple low-pressure distillation column, is enriched with argon. This gas continues its path in part toward the top of the single column, that is to say the elements 45 to 48, but is also directed toward the top of the supplementary fourth stack 54, 55, 56, 57, 58, 59, 60, 61 and 62.

On the other hand, no fluid passes from the element 53 to the element 54 through the element 13. In other configurations, at least one fluid can pass from the element 53 to the element 54 through the element 13 and vice versa.

The elements 51 to 53 can have a number of variants. They can be simple supports in which case they do not even contain insulation, being simple empty boxes. They can contain other elements useful for the process, for example pumps. The elements 51 to 53 can be modular elements according to the invention as shown in FIGS. 1 to 4 with a chamber containing a distillation packing body. They can for example constitute a denitrogenation column, with the conduits containing argon produced by the element 62 directed through the zones 5 of the elements 62 to 54, the element 13 and the zones 5 of the elements 51 to be sent to the element 51 to be distilled therein and to provide a product rich in argon coming from the element 53.

Figure 7A:
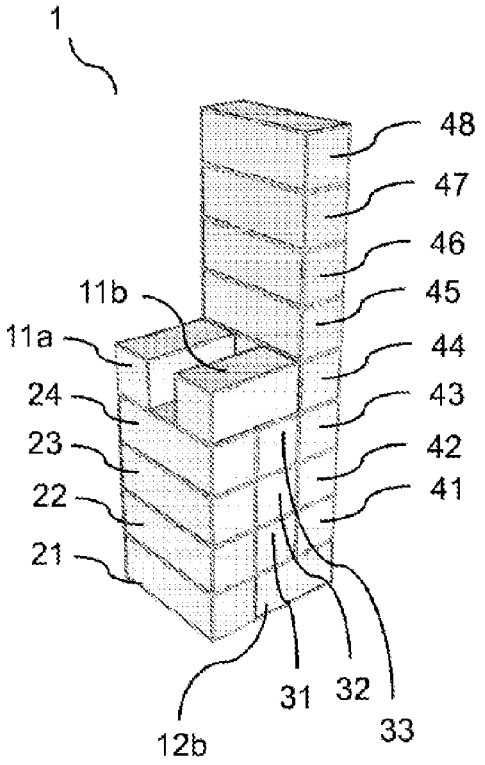
FIG. 7*a* is a schematic front view and FIG. 7*b* is a rear view of the same assembly in accordance with one embodiment of the present invention.
Figure 7B:
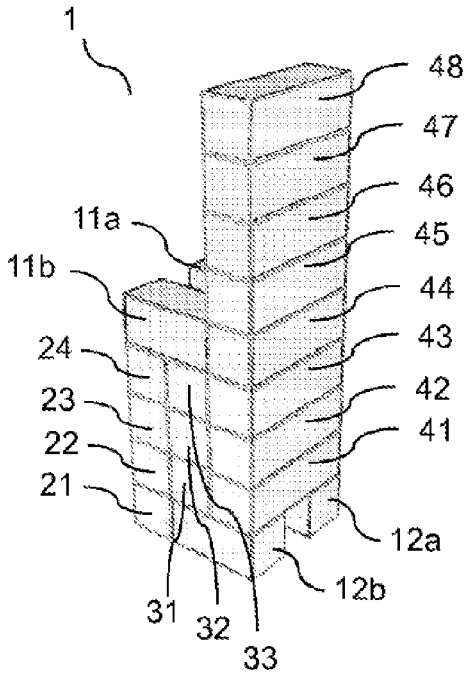

FIG. 7*a* is a front view and FIG. 7*b* is a rear view of the same assembly. In contrast to FIG. 5, the stacks of the modular elements of parallelepipedal shape that include at least eight container type ISO 101 corners fixed onto a structure are back-to-back in the direction of the length of the modular elements, instead of the width.

To fix ideas, the modular elements 21, 22, 23, 24, 31, 32, 33, 41, 42, 43, 44, 45, 46, 47 and 48 have the dimensions of a 20-foot container. If the invention as described in FIG. 5 (that is to say with a container that "straddles" two containers of two adjacent stacks directly), the connecting modular elements 11 and 12 from that figure would have a width that is twice a container format, which does not allow its transportation and handling by conventional means.

In FIGS. 7*a* and 7*b*, the horizontal connection between the first stack and the second stack, respectively the second stack and the third stack, is effected with the aid of two modular elements 11*a* and 11*b*, respectively 12*a* and 12*b*, the width and the height being those of a standard ISO container, and the length adjusted to two standard ISO container widths so as to be correctly associated with the two stacks. This configuration allows its transportation and handling by conventional means.

The connection between the first stack and the second stack could be produced thanks to a single modular element 11*a*, and that between the second stack and the third stack by a single modular element 12*a*, the modular element 12*b* then being reducible to its structural function alone.

Figure 8:
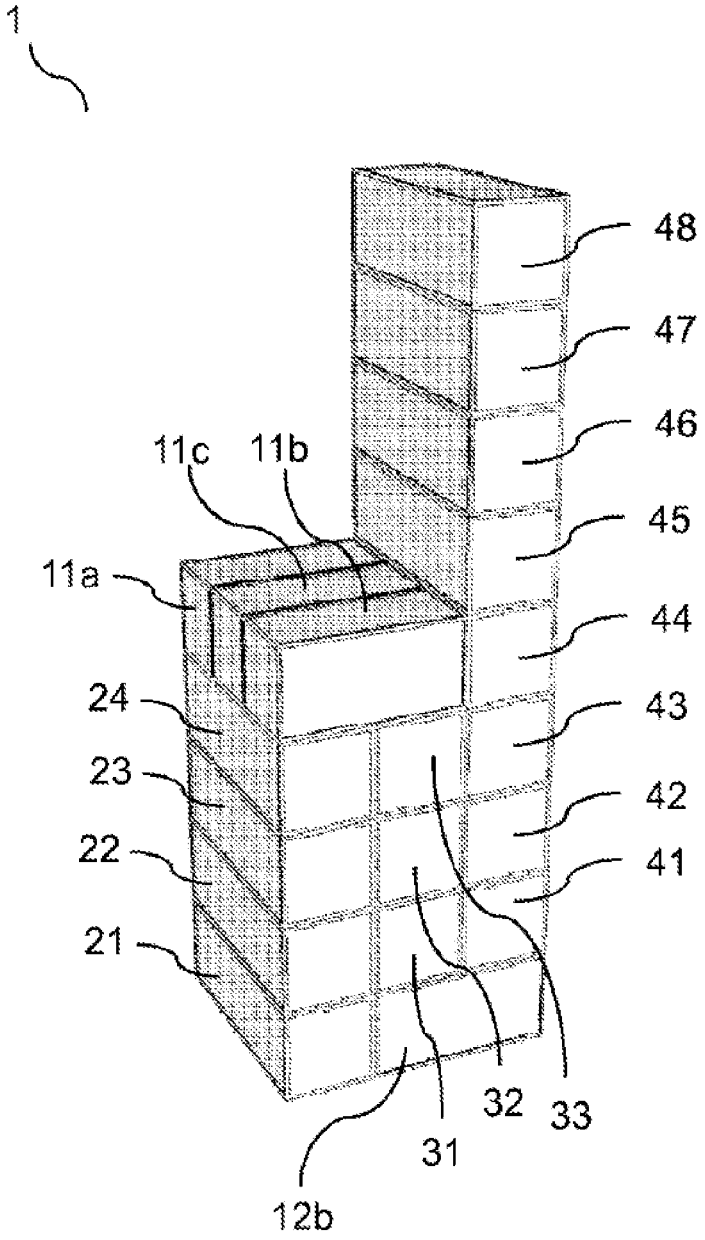
FIG. 8 is a schematic representation of the modular elements being reduced so as to place three modular elements between the two stacks, without creating any "void" between the modular elements, in accordance with one embodiment of the present invention.

In contrast to FIGS. 7*a* and 7*b*, in FIG. 8, the width of the modular elements 11*a*, 11 *b* and 11*c*, respectively 12*a*, 12*b* and 12*c* has been reduced so as to place three modular elements between the two stacks, without creating any "void" between the modular elements, whilst maintaining a format enabling its transportation and its handling by conventional ISO container means.

Figure 9:
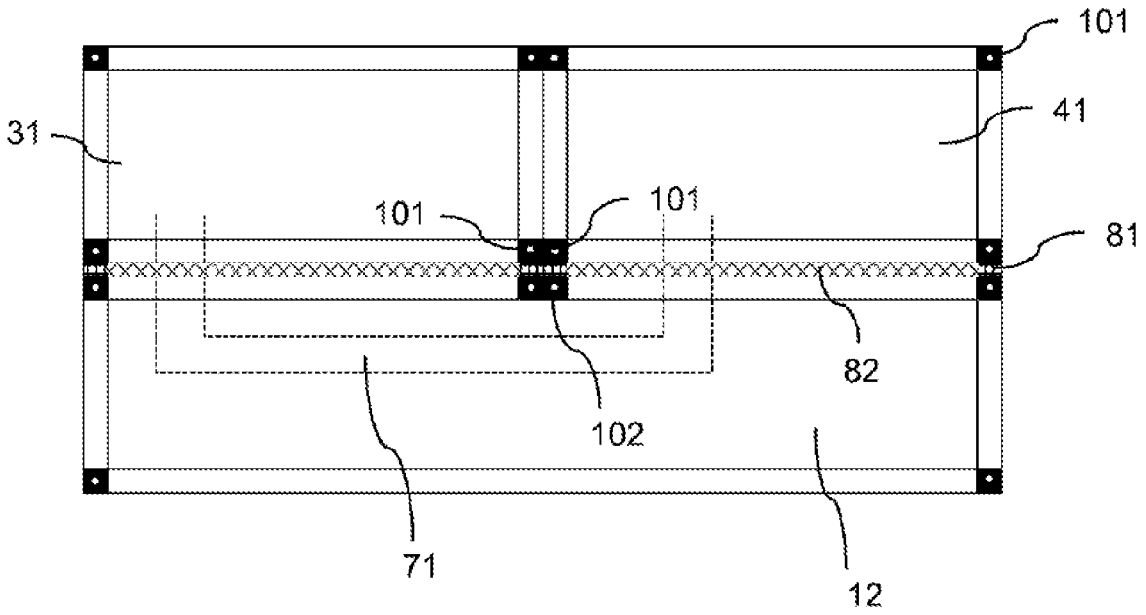
FIG. 9 is a schematic representation of the connection between the two stacks, in accordance with one embodiment of the present invention.

FIG. 9 shows the connection between the two stacks, for example the assembly 12 from FIG. 5. It is a side view. The modular elements 31 and 41 are disposed on the connecting modular element 12, which is disposed on a support that is not shown. At the level of each ISO corner there is disposed a mechanical connecting part and the element 82 provides both the seal with the outside and the continuity of insulation between the modular element 12 and the modular element 31, respectively 41, as described above. The element 71 symbolically represents a fluid duct (or pipe) that enables passage from/to the modular element 31 to/from the modular element 41 passing substantially horizontally through the modular element 12, with a vertical transfer from/to the modular element 31, respectively the modular element 41 to/from the connecting modular element 12, the junction plane then being horizontal.

The modular element 12 preferably includes intermediate ISO corners 102 to facilitate assembly with the modular elements 31 and 41.

Figure 10:
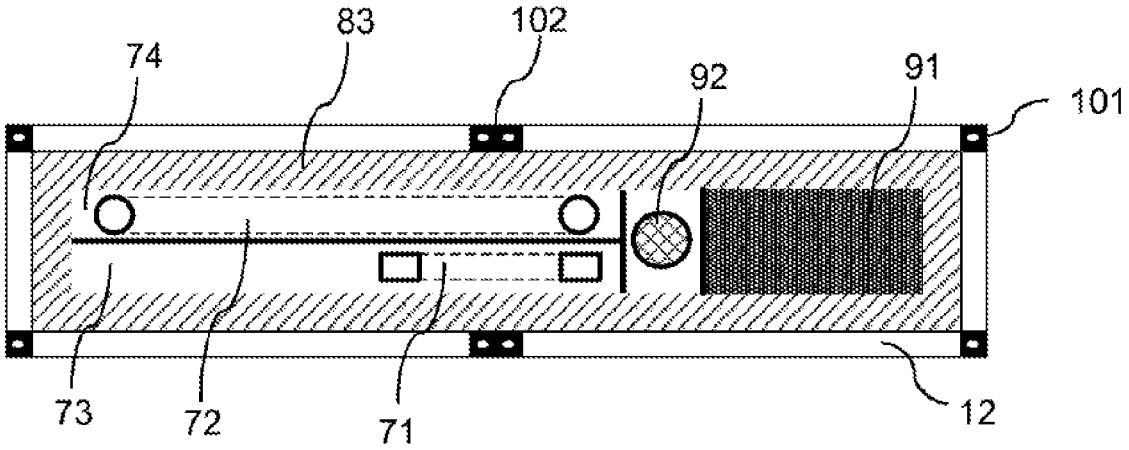
FIG. 10 is a schematic representation of an alternative to FIG. 9 for a connecting modular element in accordance with one embodiment of the present invention.

FIG. 10 shows (seen from above) an alternative to FIG. 9 for a connecting modular element 12. The element 71 is a fluid duct enabling passage from one stack to the other. The element 72 is a fluid pipe enabling passage from one stack to the other. The spaces 73 and 74 delimited by internal walls and the wall of the insulation 83 enable fluids to be caused to pass between the two stacks. The connecting modular element 12 can also contain process equipment units: for example, a process equipment unit 91, such as a matter- and/or heat-exchange body, can be delimited by the insulation 83 and an internal wall, or another process equipment piece 92 with its own container, for example a distillation column. The connecting modular element 12 can again also contain control, instrumentation and/or utilities functions.

The modular element 12 preferably includes ISO intermediate corners 102.

Figure 11:
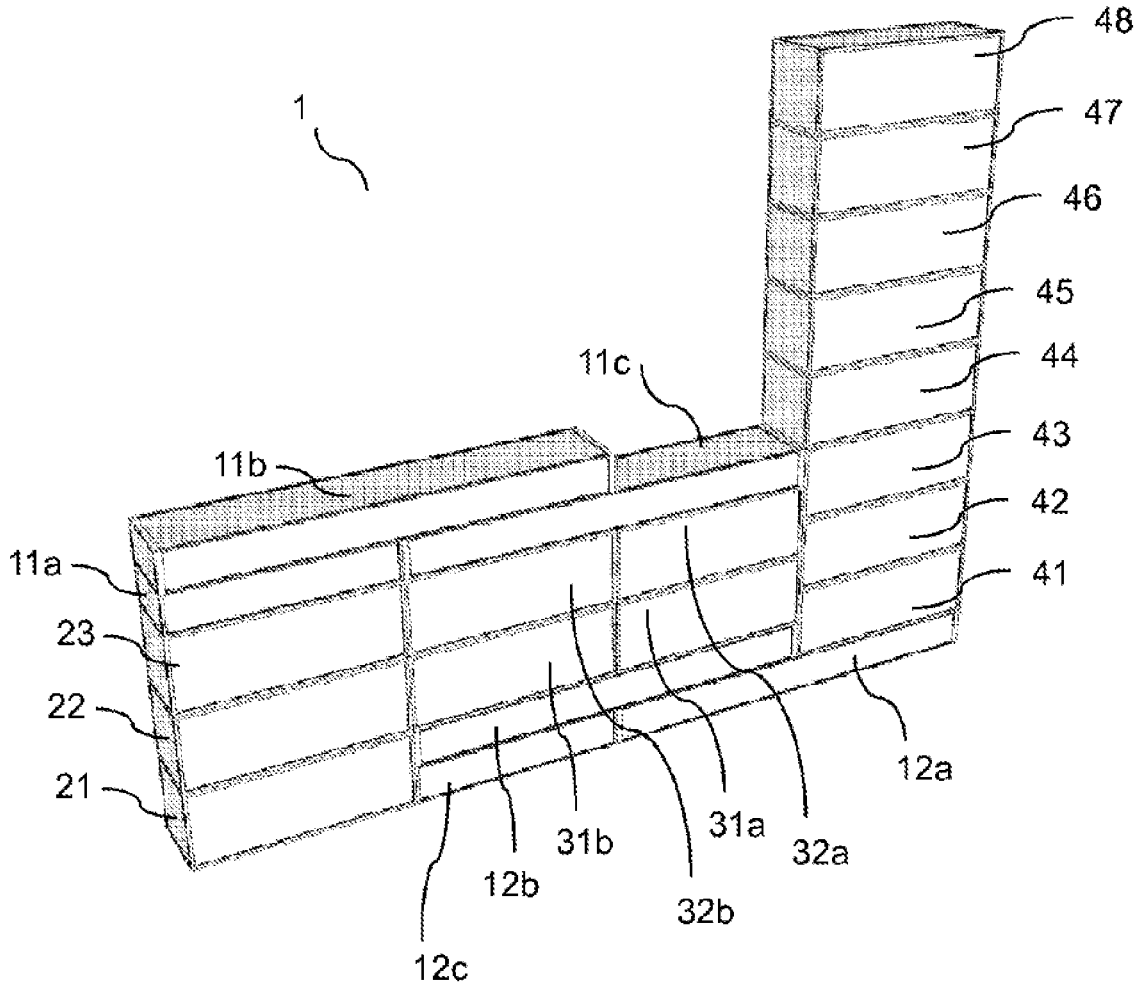
FIG. 11 is a schematic representation of an alternative to FIG. 5 with the duplication of the second stack in the form of two parallel sub-stacks in accordance with one embodiment of the present invention.

FIG. 11 differs from FIG. 5 by the duplication of the second stack in the form of two parallel sub-stacks 31*a* and 32*a*, respectively 31*b* and 32*b*. The modular elements 12*b* and 11*c* enable transfer of the fluids to/from the two sub-stacks, from the modular elements 12*a* and 11 *b*. The modular element 12*c* can be reduced to its structural function alone. The modular element 11*a* enables transfer of the fluids to/from the first stack 21, 22 and 23.

The modular elements 11*a*, 11 *b*, 11*c*, 12*a*, 12*b* and 12*c* can have the same height as the other modular elements, or preferably a reduced height, for example half the height, as shown in FIG. 11.

Figure 12:
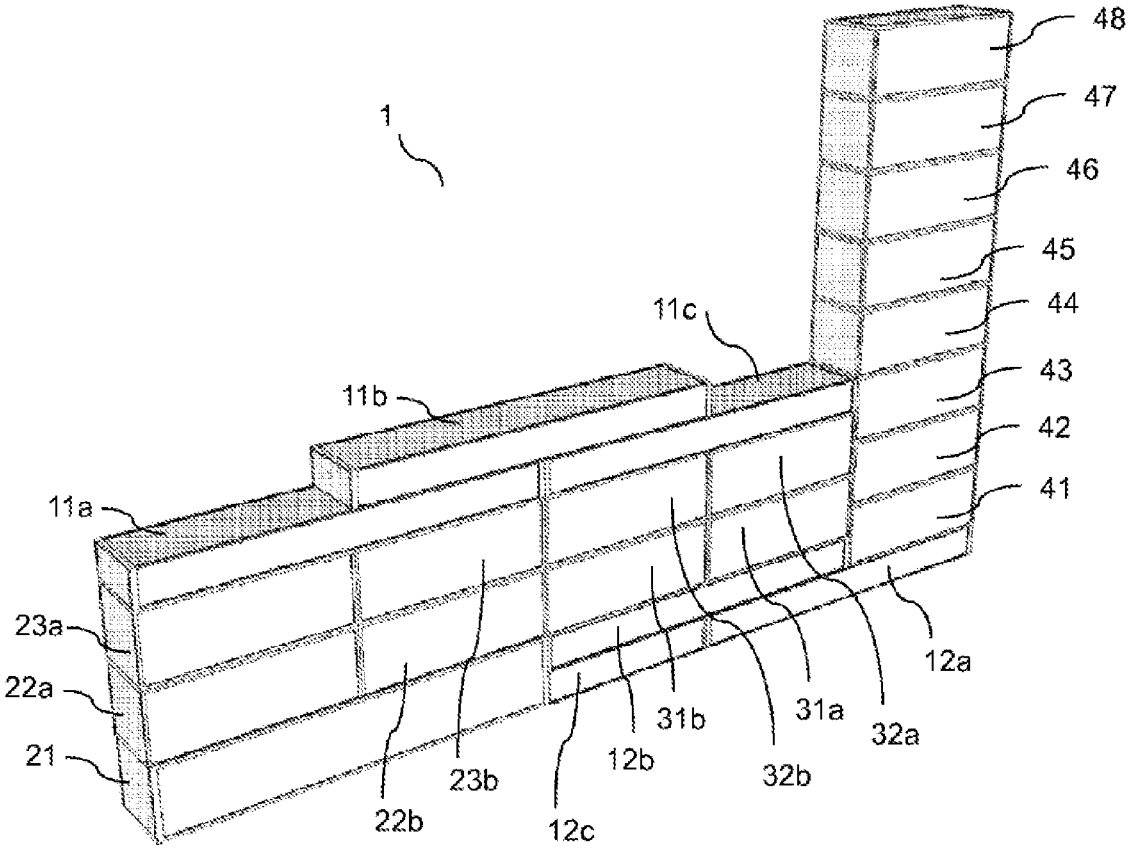
FIG. 12 a schematic representation of an alternative to FIG. 11 with the duplication of the first stack to form two parallel sub-stacks in accordance with one embodiment of the present invention.

FIG. 12 differs from FIG. 11 by the duplication of the first stack to form two parallel sub-stacks 22*a* and 23*a*, respectively 22*b* and 23*b*. The modular elements 11*a* and 21 enable transfer of the fluids to/from the two sub-stacks.

Figure 13:
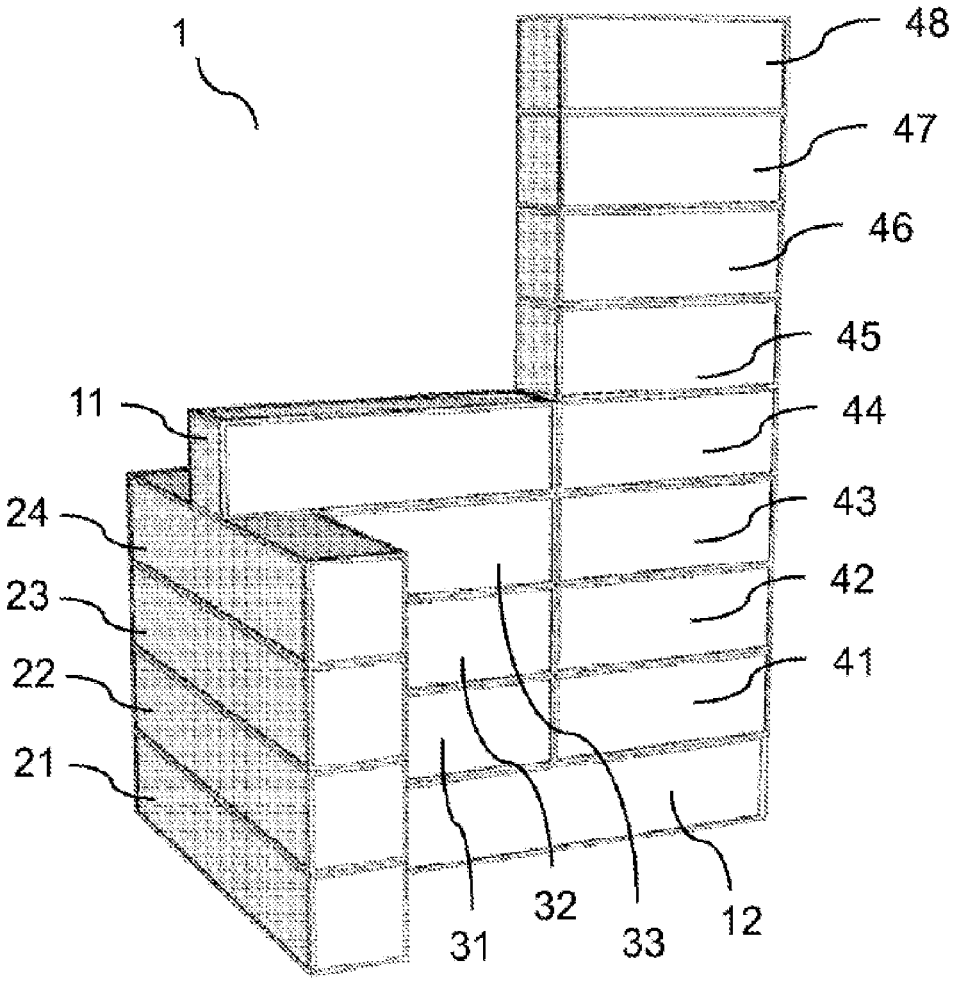
FIG. 13 a schematic representation of an alternative to FIG. 5 in that the elements are larger than the modular elements, and the connecting element has an intermediate size between so as to straddle the two stacks in accordance with one embodiment of the present invention.

FIG. 13 differs from FIG. 5 in that the elements 21, 22, 23 and 24 are larger than the modular elements 31-33 and 41-48, for example 40' containers, and the connecting element 11 has an intermediate size between 20' and 40' so as to straddle the two stacks 21-24 and 31-33. The stack 21-24 has a different, preferably perpendicular orientation to the other stacks, notably the adjacent stack 31-33.

FIGS. 14 to 22 describe a life cycle example of a gas, for example air, separation and/or liquefaction device. The device is constituted at least in part of different modular elements of parallelepipedal shape according to one of FIGS. 1 to 4 that include at least eight ISO 101 type container corners fixed to a structure, assembled for example as described above.

Figure 14:
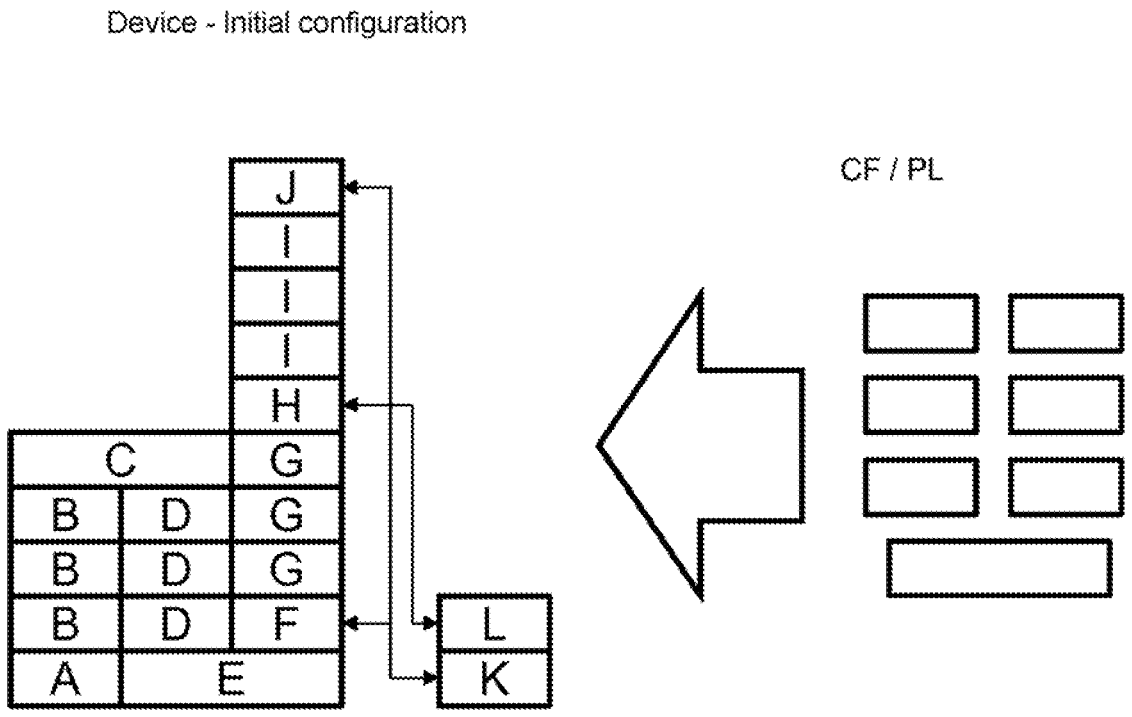
FIG. 14 is a schematic representation of the construction of the device in its initial configuration in accordance with one embodiment of the present invention.

FIG. 14 shows the construction of the device in its initial configuration. The various modular elements A, B, C, D, E, F, G, H, I, J, K and L are of two different sizes. The modular elements all have the same height and the same width. On the other hand, the modular elements C and E are substantially twice as long as the others. A, L and K may optionally also be substantially twice as long as the others.

The modular elements are stacked in three vertical stacks. Each stack is composed only of elements of one of the two sizes. The modular elements arrive from a manufacturing center CF and/or a logistical platform PL where a plurality of elements of each of the two sizes are stored. A plurality of examples of each element and each body type are stocked, in order to be able to replace any defective element. Thus a single manufacturing center and/or logistical platform is able to serve a plurality of devices in locations that are very far apart, stocking replacement elements. A quality control process makes it possible to ensure that each modular element is functional.

The various modular elements are assembled on site by stacking them to constitute at least one part of the device.

The first stack comprises an element A, surmounted by three elements B and part of the element C.

In the case of a cryogenic atmosphere gas separation device, the modular element A can contain an air blower and a pre-cooling unit, the modular elements B adsorbent to purify the air coming from the blower in A and the modular element C ducts for transfer of fluid from the first stack to the second stack and/or from the second stack to the first stack.

The modular elements are designed so that the air rises from the lowest modular element B, to the middle modular element B and then to the top modular element B, becoming purified of water and carbon dioxide and some of the secondary air impurities. The purified air is then transferred from the top modular element B to the ducts of the modular element C to pass into the second stack. The regeneration nitrogen is transferred by the modular element C of the second stack to the modular elements B.

The second stack is placed beside the first stack so that the side walls of the modular elements of the two stacks touch, possibly with a small clearance between the two.

The second stack comprises part of the modular element C containing the ducts described above, the three modular elements D each containing a heat exchange section, and part of the modular element E containing ducts for transferring at least one fluid from the second stack to the third stack and/or at least one fluid from the third stack to the second stack.

The purified air passes into the modular elements D to be cooled to a cryogenic temperature and fluids resulting from the distillation pass from the modular element E to the modular elements D to be heated.

The third stack is placed beside the second stack so that the side walls of the modular elements of the two stacks touch, possibly with a small clearance between the two.

The third stack, higher than the other two, comprises at the bottom a part of the modular element E with its fluid transfer ducts. On top of E is the modular element F, which is an evaporator. On top of F are found the stacked three modular elements G each containing a distillation section. The modular element H contains a condenser and possibly a distillation section and is found on top of the lowest of the modular elements G. Then there come the three modular elements I each containing a distillation section. On top of the higher section of the modular element I is a condenser J. Disposed beside the other sections are the modular element K that contains a heat pump for distillation and the modular element L that contains a heat pump for the refrigerating balance of the device.

It is obvious that the diagram could be simplified by eliminating the modular elements L, K and/or the condenser J. The number of modular elements B, D, G and I can be modified to produce required products or to modify the heights of the modular elements.

The installation of the device is limited to disposing the modular elements on top of one another and ensuring that they are securely attached and sealed from one another and that the stack is correctly fixed to the ground. This can be carried out by relatively unskilled labor.

Figure 15:
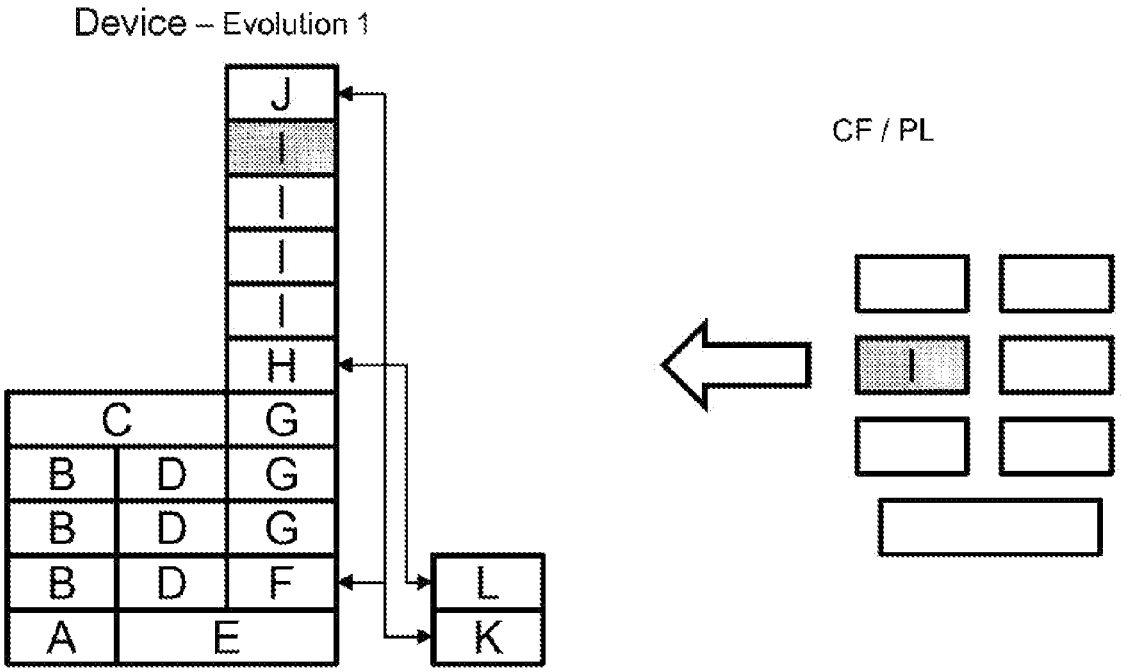
FIG. 15 shows is a schematic representation of a first evolution of the device from FIG. 14 during its life cycle in accordance with one embodiment of the present invention.

FIG. 15 shows a first evolution of the device from FIG. 14 during its life cycle. A new modular element I containing a distillation column section comes from a manufacturing center CF and/or a logistical platform PL. It is inserted between the top modular element I and the modular element J, for example to increase the purity of a product. For this it suffices to remove the condenser J, to dispose the new modular element I in place of the condenser and to place the condenser J on top of the new modular element I. In this way, four modular elements I are stacked instead of three.

In the case of a cryogenic atmospheric gas separation device, the modular element I can contain a distillation section ("minaret") with the aim of producing pure nitrogen.

To reduce the energy consumption of a device there may be added:

An evaporator/condenser modular element at the head of the column and/or in the tank of the column or at an intermediate level of the column to reduce the pinch effect on the evaporator and/or condenser or to add a supplementary intermediate evaporator or condenser function.

A modular element containing one or more distillation sections.

An exchange line modular element to the heat exchanger elements to reduce its pinch effect and therefore to reduce the consumption of the heat balance pump.

A modular element containing a "low-energy" heat pump or a modular element containing a heat pump connected in parallel with an existing heat pump or connected in part to a supplementary evaporator or condenser.

To reduce the energy consumption of a device modular elements can be replaced by modular elements of higher performance.

To modify the device to produce impure oxygen, a distillation modular element can be removed.

The modular element added or removed can also contain a liquid product pump, a liquefaction unit or a product compressor.

Figure 16:
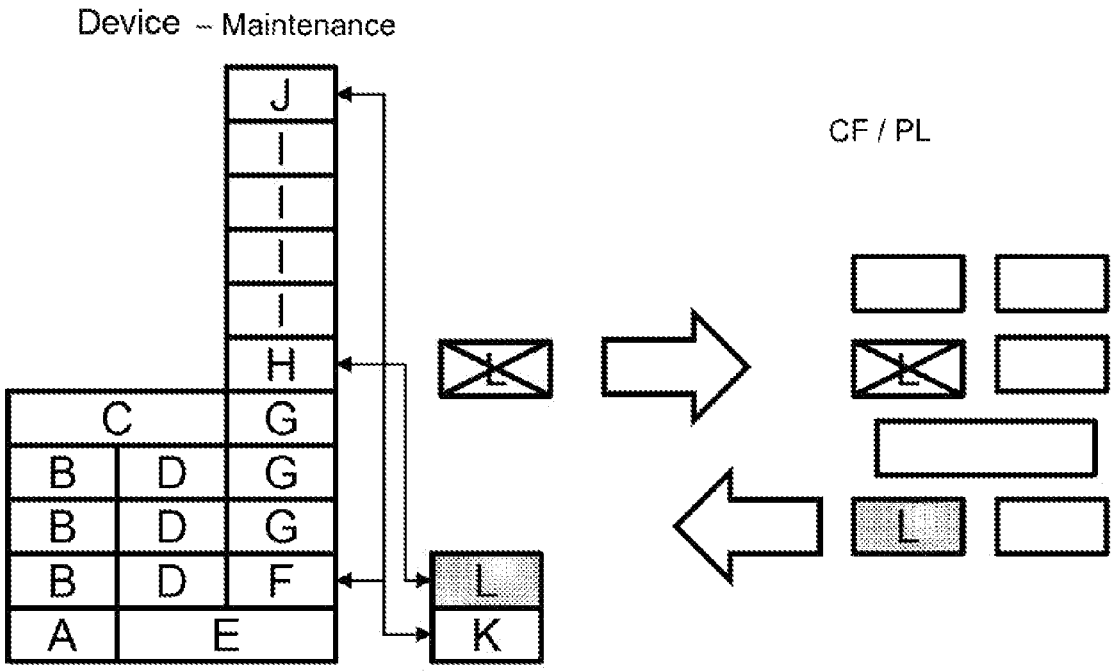
FIG. 16 is a schematic representation of the maintenance of the device from FIG. 15 during its life cycle in accordance with one embodiment of the present invention

FIG. 16 shows maintenance of the device from FIG. 15 during its life cycle. A functional modular element L arrives from a manufacturing center CF and/or a logistical platform PL and replaces the defective modular element L. The defective modular element L is sent back to the manufacturing center CF and/or to a logistical platform PL where it can be either repaired and made available again or dismantled, possibly with some of its components being recycled.

It can also be decided to replace the modular element L that is still functional with a new modular element L of better energy performance for example, or better performance in terms of capacity (debottlenecking).

This maintenance operation can obviously be effected for any element A, B, C, D, E, F, G, H, J or K of the device.

Figure 17:
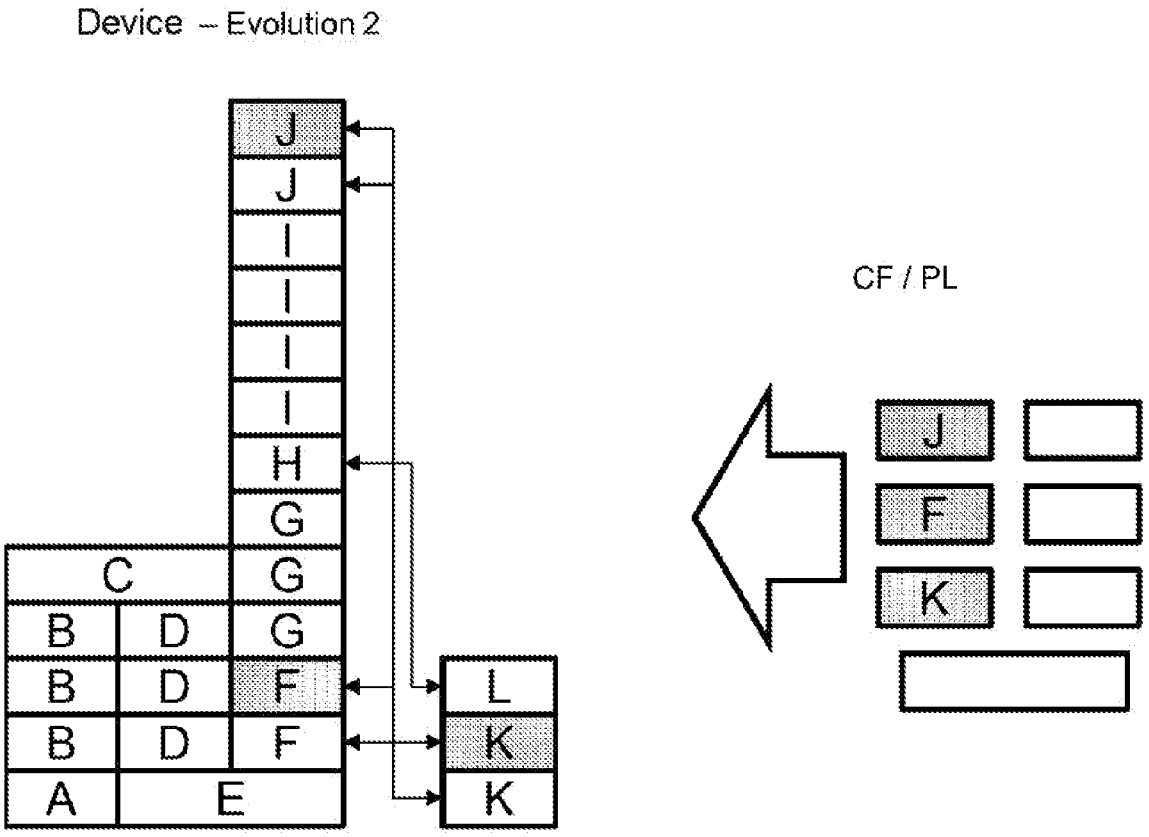
FIG. 17 is a schematic representation of a second evolution of the device from FIG. 15 during its life cycle in accordance with one embodiment of the present invention.

FIG. 17 shows a second evolution of the device from FIG. 15 during its life cycle. New modular elements J, F and K arrive from a manufacturing center CF and/or from a logistical platform PL and are inserted at various locations of the device, for example to increase the energy efficiency of the device.

In the case of a cryogenic atmosphere gas separation device, energy consumption can for example be reduced on the one hand by duplicating the evaporator by adding a modular element F and/or by duplicating the condenser by adding a modular element J, enabling the thermal pinch effect on these exchangers to be reduced, on the other hand, by duplicating the heat pump for distillation by adding a modular element K, enabling the heat pump to function with greater efficiency.

Here again the installation of the new elements is easy and it suffices to remove the other elements to dispose the new element just above or just below another modular element having the same function (and therefore identified by the same letter) or not having the same function.

Figure 18:
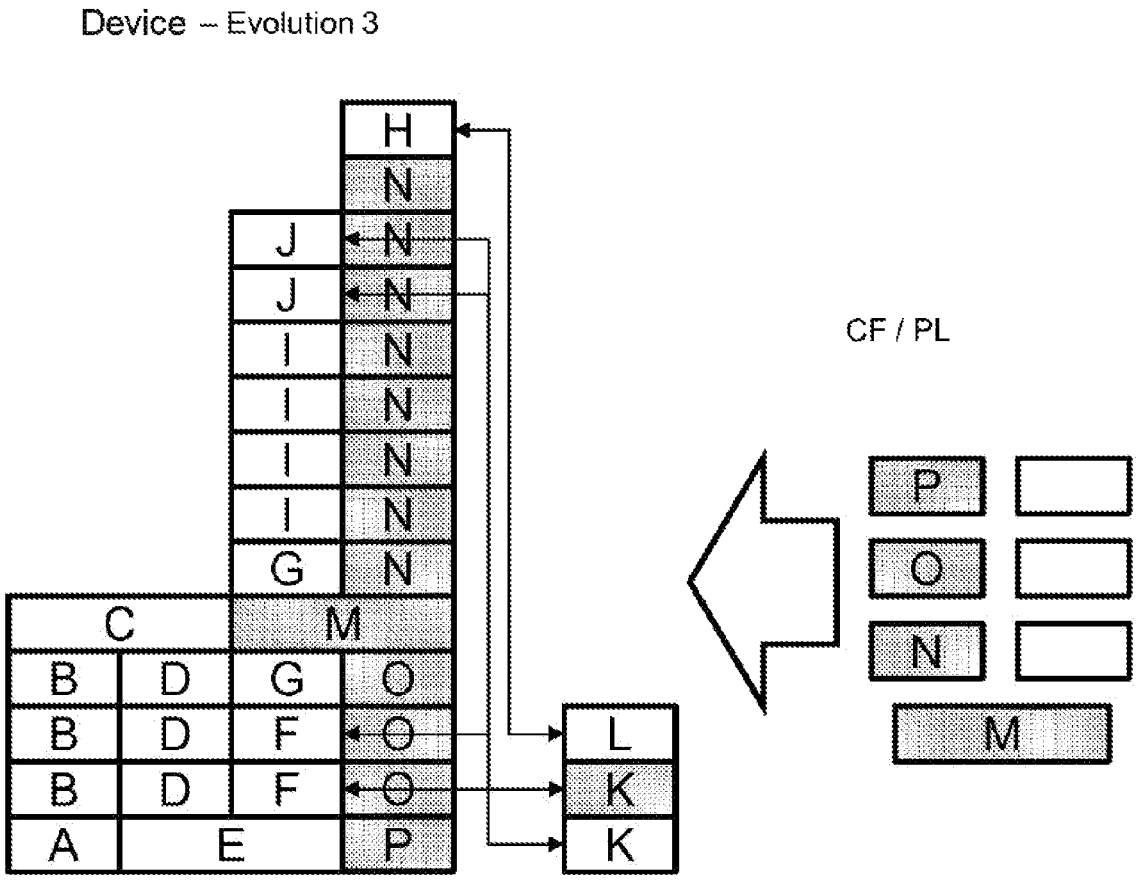
FIG. 18 is a schematic representation of a third evolution of the device from FIG. 17 during its life cycle in accordance with one embodiment of the present invention.

FIG. 18 shows a third evolution of the device from FIG. 17 during its life cycle. New modular elements M, N, 0 and P arrive from a manufacturing center CF and/or from a logistical platform PL and are inserted at various locations of the device, for example to produce another product. Here the new modular elements are disposed to form a fourth stack.

In the case of a cryogenic atmosphere gas separation device, argon may be produced for example: the modular element M can contain transfer ducts and is of the larger size. The fourth stack comprises at the bottom the modular element P that contains a liquid lifter pump, then the three stacked modular elements O each containing a distillation section. Part of the modular element M, which is inserted into the third stack, is found on top of the top modular element O. There are then found on top of the part of the modular element M in the fourth stack eight stacked modular elements N each containing a distillation section. The head of the fourth stack is surmounted by a condenser H, relocated from the existing third stack in FIG. 17.

Figure 19:
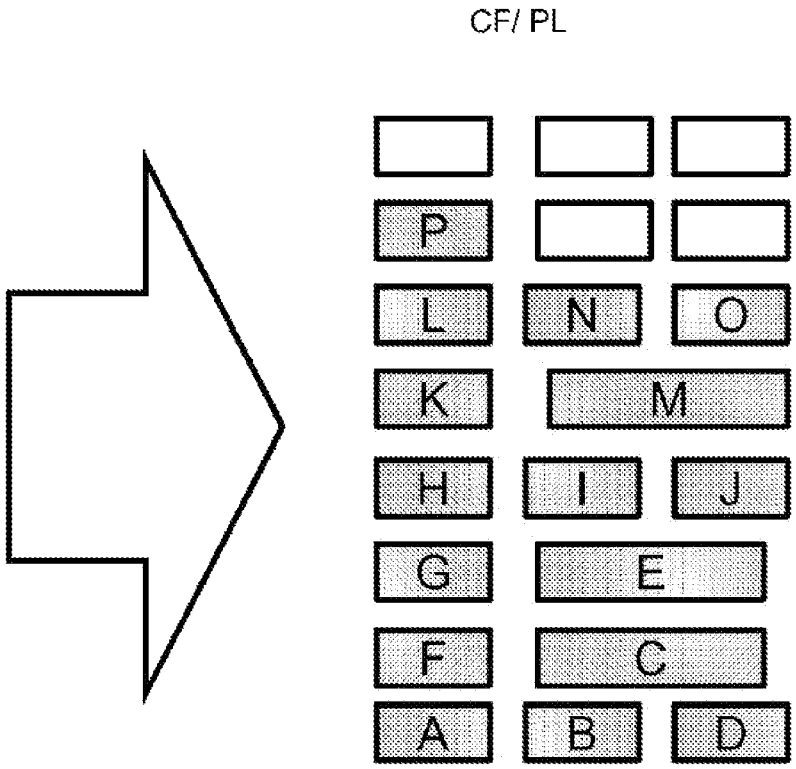
FIG. 19 is a schematic representation of the end of the life cycle of the device in accordance with one embodiment of the present invention.

FIG. 19 shows the end of the life cycle of the device. It can be either relocated to another place, or purely and simply dismantled: in the latter case at least one of the modular elements A, B, C, D, E, F, G, H, I, J, K, L, M, N, O, P is sent back to the manufacturing center CF and/or to a logistical platform PL where they can be made available again, modernized or dismantled, some of their components possibly being recycled. In particular, an element that is no longer required on a first device can be sent back to the manufacturing center or to the logistical platform, possibly stored there and sent to a second device when an element requirement manifests itself. This mode of operation has advantages of rapid intervention, economy of scale and ecological management.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore; if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents; unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A modular stackable element for construction of a device for exchange of mass and/or heat comprising:

a parallelepipedal box having a length, a width and a height;

the box comprising opposite horizontal upper and lower faces, two opposite vertical end faces and two opposite vertical lateral faces;

the upper and lower faces of the box being defined by the length and the width of the box, the two opposite vertical end faces of the box being defined by the length and the height of the box, and the two opposite vertical lateral faces of the box being defined by the width and the height of the box;

the box containing at least one layer of thermal insulation with a thickness less than one third of the width of the box;

the layer of insulation disposed within the box and covering at least the lateral and end faces of the box, the layer of insulation surrounding at least one chamber of parallelepipedal volume inside the box such that the layer of insulation is configured to reduce heat transfer between the box and the at least one chamber, and the at least one chamber having a length, a width and a height, the at least one chamber having opposite horizontal upper and lower faces, the upper face and/or the lower face of the at least one chamber being at least partially open, two opposite vertical end faces and two opposite vertical lateral faces, the upper and lower faces of the at least one chamber being defined by the length and the width of the chamber, the two end faces of the at least one chamber by the length and the height of the at least one chamber and the two lateral faces of the chamber by the width and the height of the at least one chamber;

the at least one chamber containing at least one body of material enabling the exchange of at least one of mass and of heat, the body of material being of parallelepipedal shape and filling at least a first part of the at least one chamber, the at least one chamber extending to an upper opening on the upper face of the box and a lower opening on the lower face of the box, wherein the height of the at least one chamber is substantially equal to the height of the box such that the at least one chamber is configured to fluidly connect the upper opening on the upper face of the box with the lower opening on the lower face of the box.

2. The modular stackable element of claim 1, in which the at least one body fills a part of the at least one chamber inside the box, and i) a second body enabling the exchange of at least one of mass and of heat fills a second partof the at least one chamber or a second chamber, ii) at least one material transfer conduit passes through the second chamber, or the second part of the at least one chamber, to enable the material to pass through the box, or iii) of the second part of the at least one chamber or the second chamber constitutes a means for enabling the transfer of material vertically through the box.

3. The modular stackable element of claim 1, in which the at least one body comprises adsorbent material.

4. The element of claim 1, in which the at least one body comprises a stack of vertically oriented metal plates, the plates being separated by fins.

5. The element of claim 1, in which the at least one body comprises a stack of vertically oriented corrugated plates, the corrugations being oriented at an angle between 10° and 80° to the horizontal.

6. The modular stackable element of claim 1, wherein the lower face of the at least one chamber has substantially the same dimensions as the lower opening on the lower face of the box.

7. The modular stackable element of claim 1, which does not comprise insulation in a space between the lower face of the at least one chamber and the lower opening on the lower face of the box.

8. The modular stackable element of claim 7, which has an empty space in the space between the communicating openings in the face of the at least one chamber and in the face of the box.

9. The modular stackable element of claim 1, in which the opening in at least one of the lower face and the upper face of the box occupies at least 20% of the surface of the respective face of the box.

10. The modular stackable element of claim 1, in which the opening in at least one of the lower face and the upper face of the chamber occupies at least 20% of the surface of the respective face of the chamber.

11. The element of claim 1, wherein the box comprises ISO corners such that the modular stackable element is configured for multimodal transport.

12. A stackable assembly comprising:

a bottom stackable element;

a plurality of intermediate stackable elements, the plurality of intermediate stackable elements comprising an upper intermediate stackable element and a lower intermediate stackable element; wherein each of the plurality of intermediate stackable elements comprise the modular stackable element as claimed in claim 1, and a top stackable element, wherein the plurality of intermediate stackable elements are stacked on top of the bottom stackable element, and the top stackable element is stacked on the plurality of intermediate stackable elements.

13. The stackable assembly of claim 12, in which the bottom stackable element and the lower intermediate stackable element are affixed together by connecting the lower edges of the four lateral and end walls of the box of the lower intermediate stackable element to upper edges of four lateral and end walls of a box of the bottom stackable element.

14. The stackable assembly of claim 12, wherein the stackable assembly combines to form an air purification unit, wherein at least one body of the plurality of intermediate stackable elements comprises adsorbent material and is configured to remove water and carbon dioxide from an air stream.

15. The stackable assembly of claim 12, wherein the stackable assembly combines to form a heat exchanger, wherein at least one body of the pluraility of intermediate stackable elements comprises a stack of vertically oriented metal plates, the plates being separated by fins.

16. The stackable assembly of claim 12, wherein the stackable assembly combines to form a distillation column, wherein at least one body of the pluraility of intermediate stackable elements comprises a stack of vertically oriented corrugated plates, the corrugations being oriented at an angle between 10 and 80 to the horizontal, and wherein the plurality of intermediate stackable elements all have the same length and width as the bottom stackable element and the top stackable element.

* * * * *